US005328801A

United States Patent [19]

Yasuda et al.

[11] Patent Number: 5,328,801

[45] Date of Patent: Jul. 12, 1994

[54] PHOTOGRAPHIC MATERIAL AND METHOD FOR FORMING AN IMAGE

[75] Inventors: Shoji Yasuda; Kazunobu Katoh; Hisashi Okamura, all of Kanagawa, Japan

[73] Assignee: Fuji Photo Film Co., Ltd., Kanagawa, Japan

[21] Appl. No.: 846,926

[22] Filed: Mar. 6, 1992

[30] Foreign Application Priority Data

Mar. 11, 1991 [JP] Japan ..... 3-069466

[51] Int. Cl.[5] ..... G03C 1/06

[52] U.S. Cl. ..... 430/264; 430/382; 430/434; 430/223; 430/613; 430/614; 430/957

[58] Field of Search ..... 430/264, 223, 957, 614, 430/613, 434, 382

[56] References Cited

U.S. PATENT DOCUMENTS

| | | | |
|---|---|---|---|
| 5,124,231 | 6/1992 | Sakai et al. | 430/264 |
| 5,134,055 | 7/1992 | Okamura et al. | 430/264 |
| 5,155,006 | 10/1992 | Goto et al. | 430/264 |
| 5,196,293 | 3/1993 | Okamura et al. | 430/264 |
| 5,204,214 | 4/1993 | Okamura et al. | 430/264 |

FOREIGN PATENT DOCUMENTS

| | | | |
|---|---|---|---|
| 0398285 | 11/1990 | European Pat. Off. | 430/957 |

*Primary Examiner*—Thomas R. Neville
*Attorney, Agent, or Firm*—Sughrue, Mion, Zinn, Macpeak & Seas

[57] ABSTRACT

A method for forming an image is disclosed, which comprises processing with a developer having a pH value of 9 to 12 and comprising 0.2 mol/liter or more of a sulfite an imagewise exposed silver halide photographic material comprising a compound represented by formula (I):

$$ED—(Time)_t—(Link)_s—Het \quad (I)$$

wherein Het represents a group represented by formula (II) and the remaining terms are as defined in the specification:

(II)

wherein the terms are as defined in the specification. In a preferred embodiment, the compound represented by formula (I) is a compound represented by formula (III):

$$R_1—\underset{A_1}{N}—\underset{A_2}{N}—G_1—(Time)_t—(Link)_s—Het \quad (III)$$

wherein the terms are as defined in the specification. The light-sensitive material may comprise a hydrazine derivative in addition to the compound represented by formula (I) or (III).

7 Claims, No Drawings

PHOTOGRAPHIC MATERIAL AND METHOD FOR FORMING AN IMAGE

FIELD OF THE INVENTION

The present invention relates to a silver halide photographic material and a method for forming an ultrahigh contrast negative image thereon. More particularly, the present invention relates to an ultrahigh contrast negative photographic material suitable as silver halide photographic material for use in photomechanical process.

BACKGROUND OF THE INVENTION

In the field of photomechanical processes, in order to cope with the diversity and complexity of printed matters, there is a need for a photographic material which features excellent producibility of originals and is suitable for use with a stable processing solution, and to simplify the replenishment of processing solutions.

Originals to be used in picture taking contain photocomposed letters, handwritten letters, illustrations, halftoned photographs, etc. Therefore, these originals comprise images having different densities and line widths in admixture. There has therefore been a keen desire for process cameras, photographic materials and image forming method for finishing from these originals with an excellent reproducibility. On the other hand, in plate making of catalogs and large-sized posters, the enlargement or reduction of halftoned photographs is widely required. In plate making with dots enlarged, the number of lines is reduced, blurring the picture. In plate making with dots reduced, the number of lines per unit ink is greater than the original, providing a finer picture. Accordingly, in order to maintain the desired reproducibility of halftone gradation, a method for forming an image with an even wider latitude has been desired.

The light source for process cameras is often a halogen lamp or xenon lamp. In order to obtain an enough sensitivity to an object illuminated with such a light source, the photographic material is normally subjected to orthochromatic sensitization. However, photographic materials which have been orthochromatically sensitized are more affected by the chromatic aberrations of lens and thus are more subject to deterioration of image quality than photographic materials which have not been. This deterioration becomes more remarkable with a xenon lamp.

A system which meets the need for a wide latitude is a method which comprises processing a lithographic silver halide photographic material comprising silver bromochloride (silver chloride content: at least 50% or more) with a hydroquinone developer having an extremely low effective sulfite ion concentration (normally 0.1 mol/liter or less) to provide a line image or halftone image having an image portion and a nonimage portion which are distinctly distinguished from each other, a high contrast and a high blacking density. However, since this method uses a developer with a low sulfite concentration, development is extremely unstable against air oxidation. In order to keep the solution activity constant, various measures must be taken. Further, in this method, the processing speed is extremely low, lowering the working efficiency.

Therefore, an image formation system has been desired which eliminates the instability of image formation due to the above mentioned development method (lithographic development system) by using a processing solution having an excellent preservability to develop a light-sensitive material to provide an ultrahigh contrast photograph. By way of example, a system has been proposed which comprises processing a surface latent image type silver halide photographic material comprising a specific acylhydrazine compound with a developer having an excellent preservability and a pH value of 11.0 to 12.3 and comprising 0.15 mol/liter or more of a sulfite preservative to form an ultrahigh contrast negative image with a $\gamma$ value of more than 10 as disclosed in U.S. Pat. Nos. 4,166,742, 4,168,977, 4,221,857, 4,224,401, 4,243,739, 4,272,606, and 4,311,781. This new image formation system is characterized by the fact that it can use silver bromoiodide or silver bromochloroiodide, as opposed to the conventional ultrahigh contrast image formation method which can use only silver bromochloride with a high silver chloride content.

The above mentioned image formation system provides excellent properties, i.e., sharp halftone dot quality, high processing stability, and high reproducibility of the original. In order to cope with the recent diversity of printed matters, a system with an even higher reproducibility of original is desired.

JP-A-61-213847, JP-A-62-260153, JP-A-64-88451, and JP-A-64-72140 (the term "JP-A" as used herein refers to a "published unexamined Japanese patent application"), and U.S. Pat. No. 4,684,604 disclose a light-sensitive material comprising a redox compound which undergoes oxidation to release a development inhibitor and perhaps to widen the gradation reproduction range. However, in an ultrahigh contrast processing system using a hydrazine derivative, if such a redox compound is incorporated into a light-sensitive material in an amount sufficient to optimize the reproducibility of line image and halftone image, the development inhibitor which has been released upon development partially flows out. When light-sensitive material comprising such a redox compound is continuously processed in a large amount, the development inhibitor gradually accumulates in the developer. Accordingly, when a developer fatigued from continuous processing is used to develop the light-sensitive material, a higher contrast cannot be provided or the sensitivity is reduced. In particular, when one automatic developing machine is used to develop a light-sensitive material comprising such a redox compound as well as other various light-sensitive materials for picture taking, contact light-sensitive materials and photographic materials, the latter light-sensitive material is adversely affected photographically.

Thus, the amount of such a redox compound to be incorporated into the light-sensitive material is limited. This makes it impossible to provide fully satisfactory results. Further, this process can be used only in a closed system in which a light-sensitive material and a developer are limited to narrow ranges. This system leaves much to be desired.

On the other hand, photographic materials for use in photomechanical processes are sometimes exposed to severe conditions (e.g., high temperature, high humidity) before use. In ultrahigh contrast processing systems using a hydrazine derivative, if a light-sensitive material comprising such a redox compound is exposed to these severe conditions, it can be adversely affected photographically. For example, when such a light-sensitive material is stored at a high temperature or high humidity, it is not only subject to a reduction in the sensitivity but also is prevented from providing a higher contrast, impairing its commercial value.

SUMMARY OF THE INVENTION

An object of the present invention is to provide a method for forming an ultrahigh contrast image using a novel compound with an excellent preservability which rapidly releases a development inhibitor capable of readily changing to a less inhibiting compound in a developer.

Another object of the present invention is to provide a compound which causes little fatigue of the developer even when used in an amount sufficient to optimize the image reproducibility in an ultrahigh contrast light-sensitive material system.

A further object of the present invention is to provide a light-sensitive material for use in photomechanical processes which can provide a high contrast image with little black pepper even when subjected to a developer having a high stability, and a method for forming an image thereon.

A still further object of the present invention is to provide a light-sensitive material with an excellent halftone gradation reproducibility for use in photomechanical processes from an ultrahigh contrast light-sensitive material comprising a hydrazine nucleating agent.

A further object of the present invention is to provide a light-sensitive material for use in photomechanical processes with an excellent stability in a running processing with a developer.

These and other objects of the present invention will become more apparent from the following detailed description and examples.

These objects of the present invention are accomplished by a method for forming an image, which comprises processing with a developer having a pH of 9 to 12 and comprising 0.2 mol/liter or more of a sulfite an imagewise exposed silver halide photographic material comprising a compound represented by formula (I):

$$\text{ED-(Time)}_t\text{-(Link)}_s\text{-Het} \qquad \text{(I)}$$

wherein ED represents a group which undergoes a reaction with an oxidation product of a developing agent to release $(\text{Time})_t$-$(\text{Link})_s$-Het; Time represents a divalent group which releases $(\text{Link})_s$-Het after being released from ED; Link represents a divalent group containing at least one hetero atom by which it is connected to ED-$(\text{Time})_t$; t and s each represents an integer of 0 or 1; and Her represents a group represented by Formula (II):

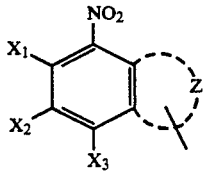

(II)

wherein $X_1$, $X_2$ and $X_3$ each represents a hydrogen atom or a monovalent group; and Z represents an atomic group required to form a 5- or 6-membered nitrogen-containing heterocyclic group, with the proviso that when the group represented by formula (II) is a nitroindazolyl group derivative, it is a 4-nitroindazolyl group derivative.

In an embodiment of the present invention, these objects of the present invention are preferably accomplished by a method for forming an image, which comprises processing the imagewise exposed silver halide photographic material comprising a compound represented by formula (III) with a developer having a pH value of 9 to 12 and comprising 0.2 mol/liter or more of a sulfite:

$$R_1\text{—}\underset{\underset{A_1}{|}}{N}\text{—}\underset{\underset{A_2}{|}}{N}\text{—}G_1\text{—(Time)}_t\text{—(Link)}_s\text{—Het} \qquad \text{(III)}$$

wherein Time, Link, Her, t and s have the same meaning as defined in formula (I); $R_1$ represents an aliphatic group or an aromatic group; $G_1$ represents —CO—, —COCO—, —CO—, —C(=$NG_2R_2$)—, —SO—, —$SO_2$— or —P(O)($G_2R_2$)—; $G_2$ represents a single bond, —O—, —S— or —N($R_2$)—; $R_2$ represents a hydrogen atom or a group having the same meaning as $R_1$, with the proviso that when there is a plurality of $R_2$groups in one molecule, they may be the same or different; and one of $A_1$ and $A_2$ is a hydrogen atom, and the other is a hydrogen atom, an acyl group, an alkyl group or an arylsulfonyl group.

In other embodiments of the present invention, Her represented by formula (II) is preferably a benzimidazole ring or a benzotriazole ring.

In still other embodiments of the present invention, $X_2$ in formula (II) is preferably a hydrogen atom or an alkyl group and $X_3$ in formula (II) is a hydrogen atom or a halogen atom.

In further embodiments of the present invention, the light-sensitive material of the present invention may comprise further a hydrazine derivative as a nucleating agent in addition to the compound represented by formula (I) or (III).

DETAILED DESCRIPTION OF THE INVENTION

The compound represented by formula (I) will be further described hereinafter.

In formula (I), the group represented by ED undergoes reaction with an oxidation product of a developing agent during development to release $(\text{Time})_t$-$(\text{Link})_s$-Het. Specific examples of such a group include a group which undergoes a coupling reaction with an oxidation product of an aromatic amine developing agent during development to release $(\text{Time})_t$-$(\text{Link})_s$-Het and a redox group which undergoes a reaction in one or several stages after being oxidized during development by oxidation products of various developing agents to release $(\text{Time})_t$-$(\text{Link})_s$-Het.

Preferred among these groups represented by ED are redox groups. Preferred redox groups include hydroquinones, catechols, naphthohydroquinones, aminophenols, pyrazolidones, hydrazines, hydroxylamines, and reductones. Particularly preferred among these redox groups are hydrazines and hydroquinones.

In formula (III), the aliphatic group represented by $R_1$ is preferably an aliphatic group having 1 to 30 carbon atoms, particularly a straight-chain, branched or cyclic alkyl group having 1 to 20 carbon atoms which may contain substituents.

In formula (III), the aromatic group represented by $R_1$ is preferably a monocyclic or bicyclic aryl group or an unsaturated heterocyclic group. The unsaturated heterocyclic group may be condensed with an aryl group to form a heteroaryl group. The aryl group in the above groups has preferably from 4 to 20 carbon atoms and more preferably from 5 to 14 carbon atoms.

Examples of such an aromatic groups include a benzene ring, a naphthalene ring, a pyridine ring, a quinoline ring, and an isoquinoline ring. Particularly preferred among these groups are those containing a benzene ring.

Particularly preferred among these groups represented by $R_1$ is an aryl group.

The aryl group or unsaturated heterocyclic group represented by $R_1$ may be substituted by substituents. Typical examples of such substituents include an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an aryloxycarbonyl group, an acyl group, an alkoxycarbonyl group, an acyloxy group, a carbonamide group, a sulfonamide group, a carboxyl group, and a phosphoric amide group. Preferred examples of such substituents include straight-chain, branched or cyclic alkyl groups (preferably containing 1 to 20 carbon atoms), aralkyl groups (preferably containing 7 to 30 carbon atoms), alkoxy groups (preferably containing 1 to 30 carbon atoms), substituted amino groups (preferably amino group substituted by an alkyl group having 1 to 30 carbon atoms), acylamino groups (preferably containing 2 to 40 carbon atoms), sulfonamide groups (preferably containing 1 to 40 carbon atoms), ureido groups (preferably containing 1 to 40 carbon atoms), and phosphoric amide groups (preferably containing 1 to 40 carbon atoms).

In formula (III), $G_1$ is preferably —CO— or —$SO_2$—, most preferably —CO—.

The group represented by $A_1$ and $A_2$ is preferably a hydrogen atom.

In formula (I) or (III), Time represents a divalent linking group which may serve to adjust timing. The divalent linking group represented by Time releases $(Link)_s$-Het from Time-$(Link)_s$-Het which has been released from ED by a reaction of one or more stages.

Examples of the divalent linking groups represented by Time include compounds which undergo an intramolecular ring closure reaction of a p-nitrophenoxy derivative to release $(Link)_s$-Het as disclosed in U.S. Pat. No. 4,248,962 (corresponding to JP-A-54-145135), compounds which undergo an intramolecular ring closure reaction after ring cleavage to release $(Link)_s$-Het as disclosed in U.S. Pat. Nos. 4,310,612 (corresponding to JP-A-55-53330) and 4,358,525, compounds which undergo an intramolecular ring closure reaction of a carboxyl group in succinic monoester or its analogs to release $(Link)_s$-Het with formation of acid unhydrates as disclosed in U.S. Pat. Nos. 4,330,617, 4,446,216, and 4,483,919, and JP-A-59-121328, compounds which undergo electron transfer via a double bond conjugated with an aryloxy group or a heterocyclic oxy group to produce a quinomonomethane or its analogs to release $(Link)_s$-Het as disclosed in U.S. Pat. Nos. 4,409,323, 4,421,845, and 4,416,977 (corresponding to JP-A-57-135944), *Research Disclosure,* No. 21228 (December, 1981), and JP-A-58-209736 and JP-A-58-209738, compounds which undergo electron transfer in the enamine structure portion in a nitrogen-containing heterocyclic group to release $(Link)_s$-Het from the 7-position in the enamine as disclosed in U.S. Pat. No. 4,420,554 (corresponding to JP-A-57-136640), and JP-A-57-135945, JP-A-57-188035, JP-A-58-98728, and JP-A-58-209737, compounds which undergo electron transfer to a carbonyl group conjugated with a nitrogen atom in a nitrogen-containing heterocyclic group to release $(Link)_s$-Het as disclosed in JP-A-57-56837, compounds which release -Het with the production of aldehydes as disclosed in U.S. Pat. No. 4,146,396 (corresponding to JP-A-52-90932), and JP-A-59-93442, JP-A-59-75475, JP-A-60-249148, and JP-A-60-249149, compounds which release $(Link)_s$-Het with the decarboxylation of a carboxyl group as disclosed in JP-A-51-146828, JP-A-57-179842, and JP-A-59-104641, compounds which form the structural formula -0—$COOCR_aR_b$-$(Link)_s$-Het (in which $R_a$ and $R_b$ each represents a monovalent group) which release $(Link)_s$-Het with the production of aldehydes which are then decarboxylated, compounds which release $(Link)_s$-Het with the production of isocyanate as disclosed in JP-A-60-7429, and compounds which undergo a coupling reaction with an oxidation product of a color developing agent to release $(Link)_s$-Het as disclosed in U.S. Pat. No. 4,438,193.

Specific examples of the divalent linking group represented by Time are further described in JP-A-61-236549 and JP-A-1-269936, and Japanese Patent Application No. 2-93487.

In formula (I) or (III), Link represents a divalent group containing hetero atoms. Preferred examples of such a divalent group include —O—, —S—, —NH-$SO_2$—, —$SO_2$—, —O—CO—, and groups formed by combining these groups with an alkylene group (preferably having 1 to 20 carbon atoms) or an arylene group (preferably having 1 to 20 carbon atoms).

The Het group represented by formula (II) will be further described hereinafter. Het is a nitrogen-containing heterocyclic group condensed with a benzene ring containing a nitro group as a substituent. Typical examples of such nitrogen-containing heterocyclic groups include an indole ring, an isoindole ring, an indazole ring, a benzimidazole ring, a benzotriazole ring, a quinoline ring, an isoquinoline ring, a phthalazine ring, a quinoxaline ring, a quinazoline ring, a cinnoline ring, a carbazole ring, a phenanthridine ring, an acridine ring, a phenanthroline ring, a phenazine ring, a phenothiazine ring, a phenoxazine ring, a benzoxazole ring, a benzisoxazole ring, a benzothiazole ring, a benzisothiazole ring, and partially saturated rings thereof (e.g., an indoline ring, a dihydroquinoline ring). (These groups are in the form of a heterocyclic skeleton free of nitro groups. Further, a derivative of a nitroindazolyl group represents 4-nitroindazolyl.)

Preferred among these rings are an indole ring, an indazole ring, a benzimidazole ring, a benzotriazole ring, a quinoline ring, a benzoxazole ring, and a benzothiazale ring. Particularly preferred among these rings are a benzimidazole ring and a benzotriazole ring.

When S is 0, Het is preferably connected to ED-$(Time)_t$ via a hetero atom.

Examples of the monovalent group represented by $X_1$, $X_2$ and $X_3$ include those described as substituents for $R_1$ in formula (III), a nitro group, and a nitroso group.

The aliphatic group represented by X1, $X_2$ or $X_3$ is preferably a straight-chain, branched or cyclic alkyl having 1 to 10 carbon atoms, alkenyl or alkynyl group. The alkyl group may be substituted by an aryl group to form an aralkyl group having 7 to 10 carbon atoms. Specific examples of such an alkyl group include a methyl group, an ethyl group, an isopropyl group, a t-butyl group, and a benzyl group.

The aromatic group represented by X1, $X_2$ or $X_3$ is preferably an aryl group having 6 to 10 carbon atoms or an unsaturated heterocyclic group having 5 to 10 carbon atoms which may be substituted by substituents.

Examples of such substituents include those described in examples of the above monovalent group represented by $X_1$, $X_2$ or $X_3$ (i.e., those described as substituents for $R_1$ in formula (III), a nitro group and a nitroso group). Specific examples of such substituents include a substituted or unsubstituted phenyl group, a naphthyl group, a pyridyl group, a quinolyl group, and an isoquinolyl group.

$X_2$ is preferably a hydrogen atom or an alkyl group, and $X_3$ is preferably a hydrogen atom or a halogen atom.

Het may be substituted by substituents other than X1, $X_2$ and $X_3$. Examples of such substituents include those described in examples of the above monovalent group represented by X1, $X_2$ and $X_3$.

ED or Time in formula (I) and $R_1$ or Time in formula (III) may comprise a group for accelerating the adsorption of a ballast group commonly used in an immobile photographic additive such as a coupler or a compound represented by formula (I) or $(II)_f$ silver halide.

The ballast group is an organic group which provides the compound represented by formula (I) or (III) with a sufficient molecular weight so that the compound cannot substantially diffuse into other layers or processing solution. The ballast group consists of one or a combination of alkyl groups, aryl groups, heterocyclic groups, ether groups, thioether groups, amide groups, ureido groups, urethane groups and sulfonamide groups. This ballast group is preferably one containing a substituted benzene ring, particularly a ballast group containing a benzene ring substituted by a branched alkyl group.

Specific examples of a group which accelerates adsorption to silver halide include cyclic or chain thioamide groups such as 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-oxazoline-2-thione, benzimidazoline-2-thione, benzoxazoline-2-thione, benzothiazoline-2-thione, thiotriazine and 1,3-imidazoline-2-thione; aliphatic mercapto groups; aromatic mercapto groups; heterocyclic mercapto groups (when the atom next to the carbon atom to which the —SH group is connected is a nitrogen atom, the heterocyclic mercapto group has the same meaning as a cyclic thioamide group in tautomerism therewith, and specific examples of such a cyclic thioamide group are the same as described above); groups containing a disulfide bond, 5- or 6-membered nitrogen-containing heterocyclic groups comprising a combination of nitrogen, oxygen, sulfur and carbon atoms such as benzotriazole, triazole, tetrazole, indazole, benzimidazole, imidazole, benzothiazole, thiazole, thiazoline, benzoxazole, oxazole, oxazoline, thiadiazole, oxathiazole, triazine and azaindene; and heterocyclic quaternary salts such as benzimidazolium.

These adsorption accelerating groups may be substituted by proper substituents.

Examples of such substituents include those described as substituents for $R_1$ in formula (III).

Specific examples of the compound to be used in the present invention are shown below, but the present invention should not be construed as being limited thereto.

(1)

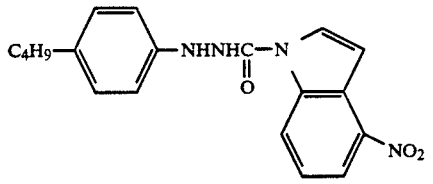

(2)

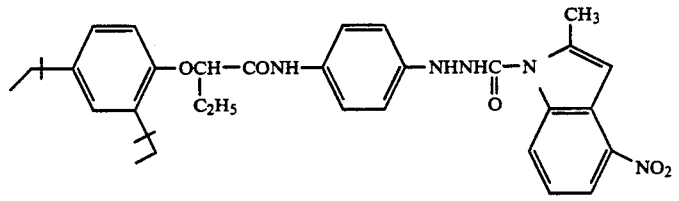

(3)

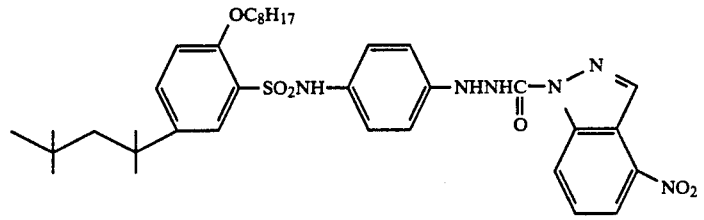

-continued
(4)
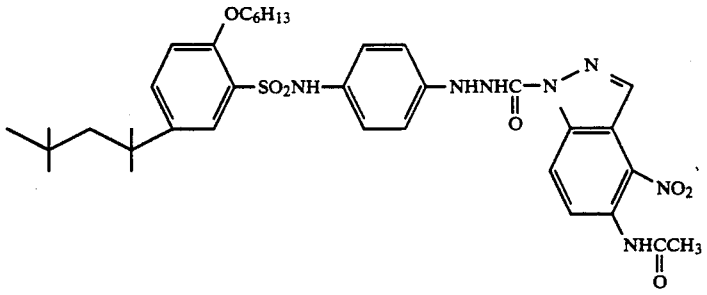
(5)
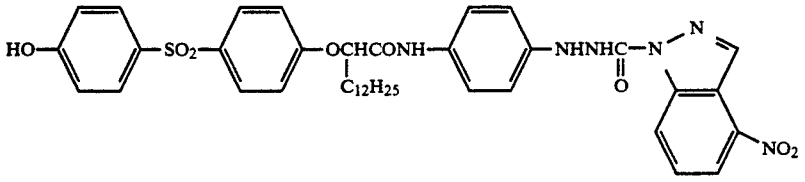
(6)
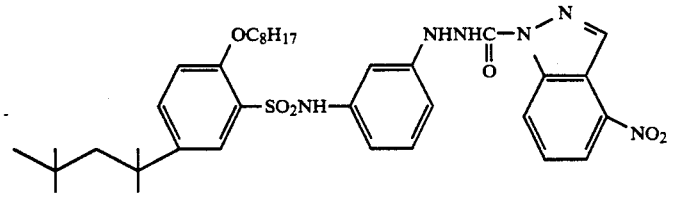
(7)
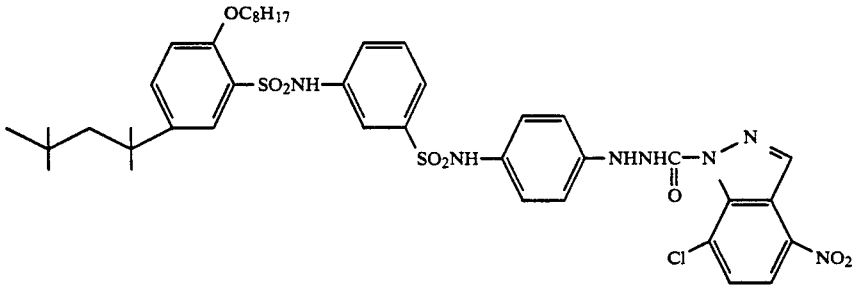
(8)
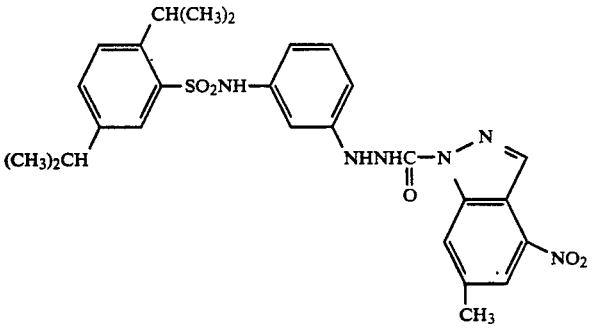
(9)
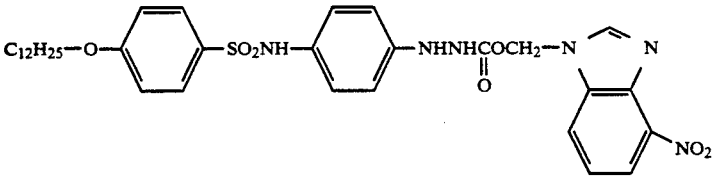

-continued
(10)
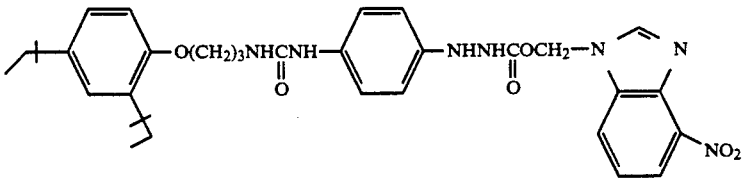
(11)
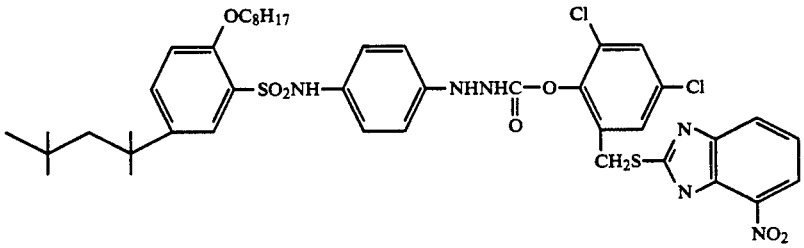
(12)
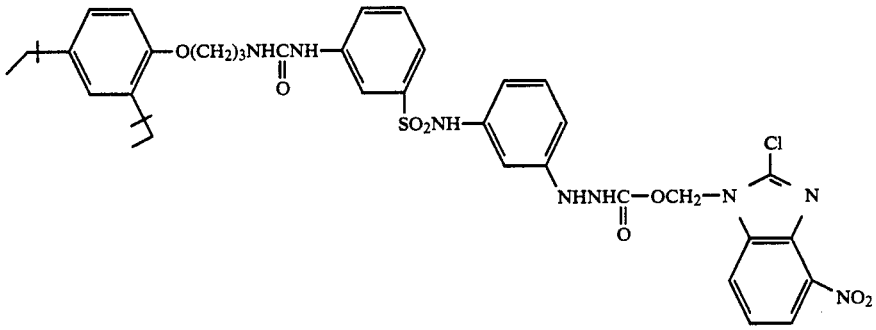
(13)
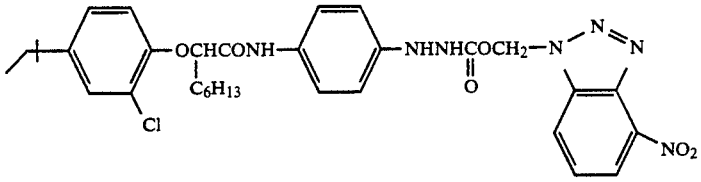
(14)
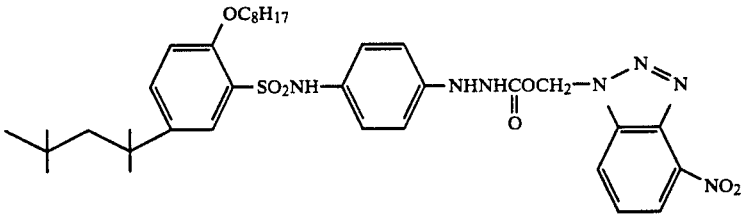
(15)
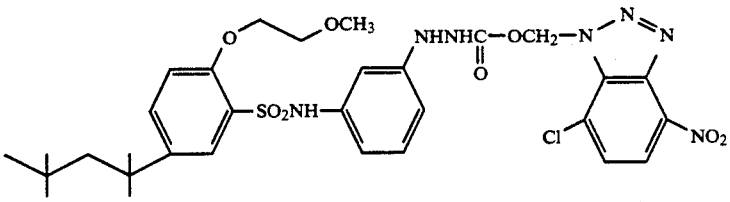
(16)
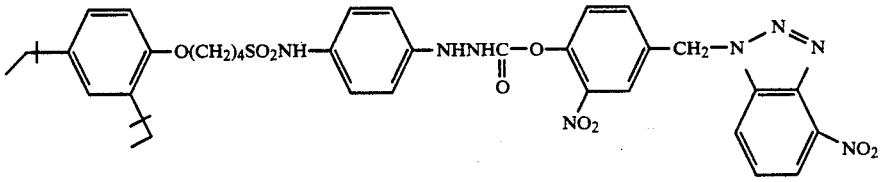

-continued
(17)
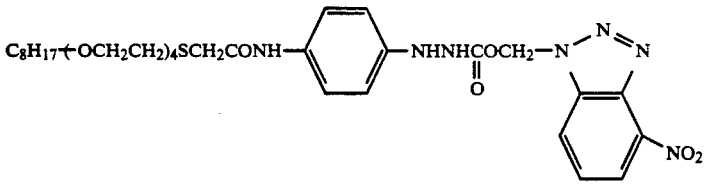
(18)
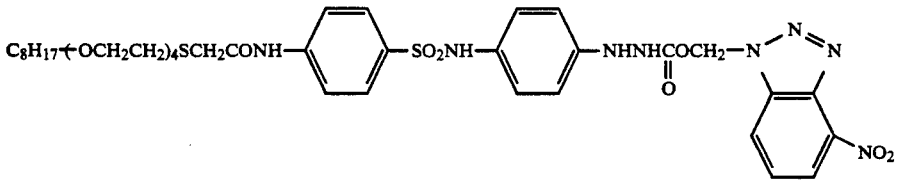
(19)
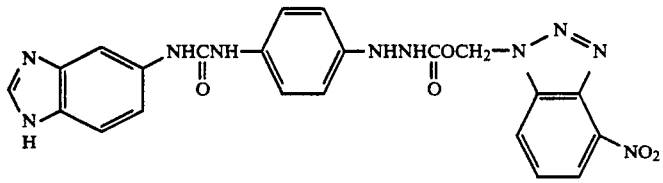
(20)
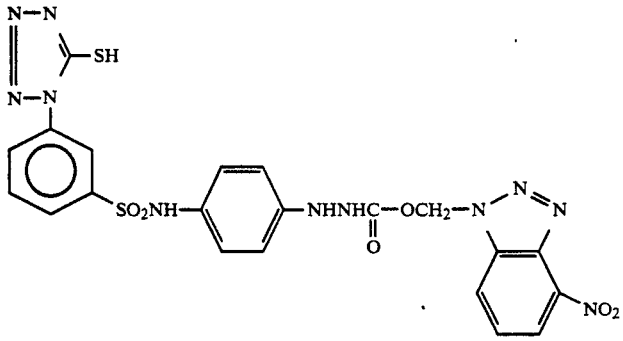
(21)
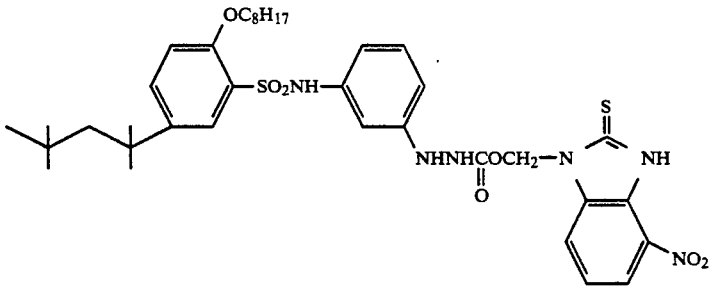
(22)
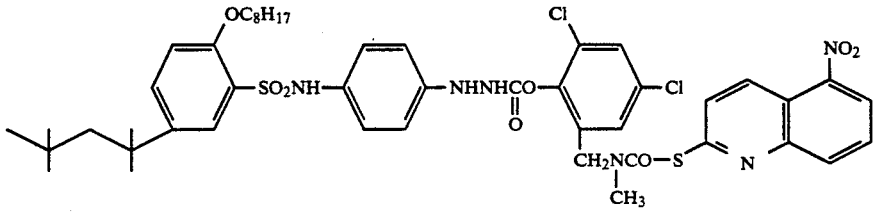

-continued
(23)
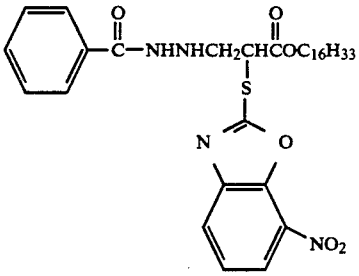
(24)
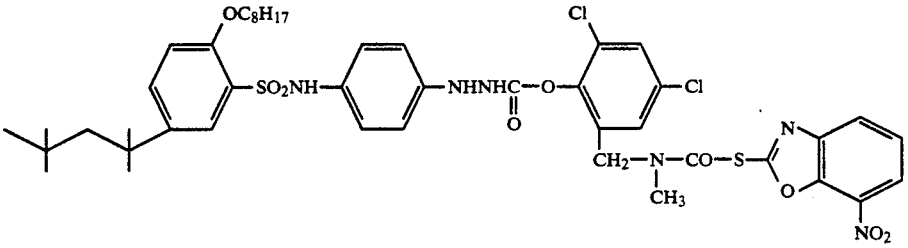
(25)
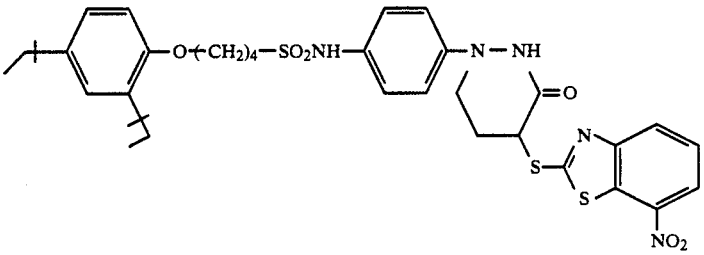
(26)
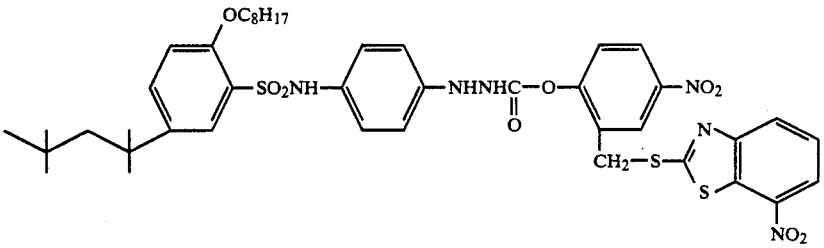
(27)
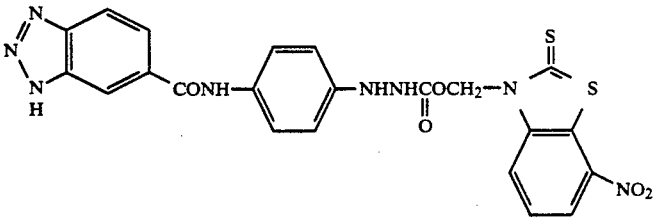
(28)
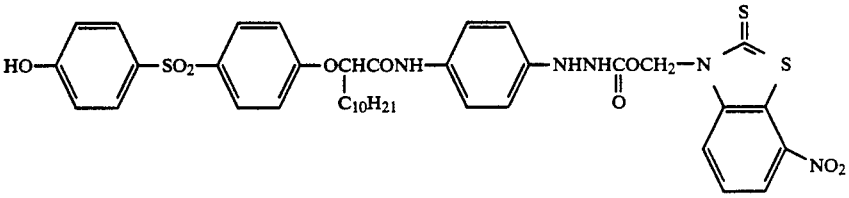

-continued (29)

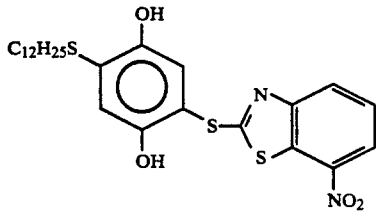

(30)

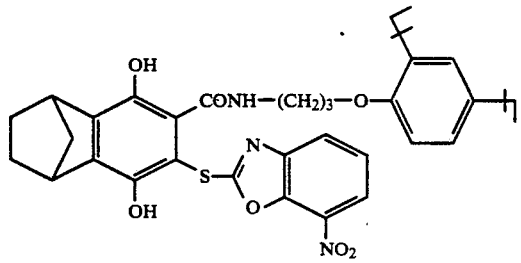

(31)

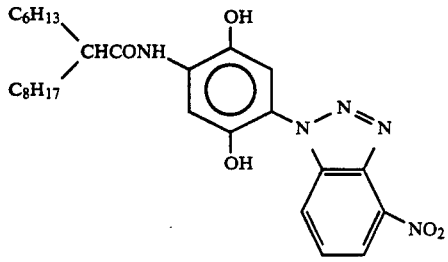

(32)

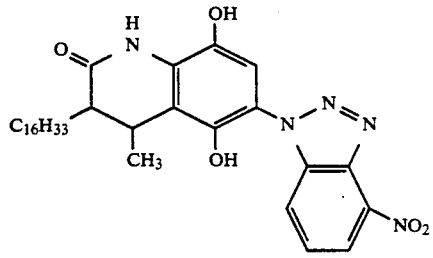

Specific examples of the method for the synthesis of compounds to be used in the present invention are described in JP-A-61-213847, and JP-A-62-260153, U.S. Pat. No. 4,684,604, and Japanese Patent Application Nos. 2-62337, 2-64717, and 1-290563.

The compound represented by formula (I) is used in an amount of $1\times10^{-6}$ to $5\times10^{-2}$ mol, preferably $1\times10^{-5}$ to $1\times10^{-2}$ mol, per mol of the silver halide.

The compound represented by formula (I) may be used in the form of a solution in a proper organic solvent miscible with water, such as alcohols (e.g., methanol, ethanol, propanol, fluorinated alcohol), ketones (e.g., acetone, methyl ethyl ketone), dimethylformamide, dimethyl sulfoxide and methyl cellosolve.

The compound represented by formula (I) may also be used in the form of an emulsion dispersion mechanically prepared by a known emulsion dispersion method using an oil such as dibutyl phthalate, tricresyl phosphate, glyceryl triacetate and diethyl phthalate or an auxiliary solvent such as ethyl acetate and cyclohexanone or in the form of a dispersion prepared by a method known as a solid dispersion method using ball mill, colloid mill or ultrasonic wave to disperse powders of the compound represented by formula (I) in water.

The compound represented by formula (I) is incorporated into silver halide emulsion layers or other hydrophilic colloidal layers. Further, the compound represented by formula (I) may be incorporated into at least one of a plurality of silver halide emulsion layers.

The light-sensitive material of the present invention preferably comprises a hydrazine derivative as a nucleating agent.

The hydrazine derivative to be used in the present invention is preferably a compound represented by formula (IV):

$$E_1-\underset{\underset{B_1}{|}}{N}-\underset{\underset{B_2}{|}}{N}-V_1-E_2 \qquad \text{(IV)}$$

wherein $E_1$ represents an aliphatic group or an aromatic group; $E_2$ represents a hydrogen atom, an alkyl group, an aryl group, an alkoxy group,-an aryloxy group, an amino group or a hydrazino group; $V_1$ represents —CO—, —$SO_2$—, —SO—, —P(O)(E3)—, —CO—CO—, a thiocarbonyl group or an iminomethylene group; $B_1$ and $B_2$ each represents a hydrogen atom or one of $B_1$ and $B_2$ represents a hydrogen atom and the other represents a substituted or unsubstituted alkylsulfonyl group, a substituted or unsubstituted arylsulfonyl group or a substituted or unsubstituted acyl group; and $E_3$ has the same meaning as $E_2$ and may be the same or different from $E_2$.

In formula (IV), the aliphatic group represented by $E_1$ is preferably an aliphatic group having 1 to 30 carbon atoms, particularly a straight-chain, branched or cyclic alkyl group having 1 to 20 carbon atoms which may contain substituents.

In formula (IV), the aromatic group represented by $E_1$ is a monocyclic or bicyclic aryl group or an unsaturated heterocyclic group. The unsaturated heterocyclic group may be condensed with an aryl group.

The group represented by $E_1$ is preferably an aryl group, particularly an aryl group containing a benzene ring.

The aliphatic group or aromatic group represented by $E_1$ may be substituted by substituents. Typical examples of such substituents include an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkylthio group, an arylthio group, an alkylsulfonyl group, an arylsulfonyl group, an alkylsulfinyl group, an arylsulfinyl group, a hydroxyl group, a halogen atom, a cyano group, a sulfo group, an aryloxycarbonyl group, an acyl group, an alkoxycarbonyl group, an acyloxy group, a carbonamide group, a sulfonamide group, a carboxyl group, a phosphoric amide group, a diacylamino group, an imide group, and an E4—NHCO—N(E5)—CO— group (in which $E_4$ and $E_5$have the same meaning as $E_2$ and may be the same or different). Preferred examples of such substituents include an alkyl group (preferably containing 1 to 20 carbon atoms), an aralkyl group (preferably containing 7 to 30 carbon atoms), an alkoxy group (preferably 1 to 20 carbon atoms), a substituted amino group (preferably an amino group substituted by an alkyl group having 1 to 20 carbon atoms), an acylamino group (preferably containing 2 to 30 carbon atoms), a sulfonamide group (preferably containing 1 to 30 carbon atoms), a ureido group (preferably containing 1 to 30 carbon atoms), and a phosphoric amide group (preferably containing 1 to 30 carbon atoms). These groups may be further substituted by substituents.

In formula (IV), the alkyl group represented by $E_2$ is preferably an alkyl group having 1 to 4 carbon atoms. The aryl group represented by $E_2$ is preferably a monocyclic or bicyclic aryl group (e.g., an aryl group containing a benzene ring).

When $V_1$ represents a —CO— group, preferred among the groups represented by $E_2$ are a hydrogen atom, an alkyl group (e.g., methyl, trifluoromethyl, 3-hydroxypropyl, 3-methanesulfonamidopropyl, phenylsulfonylmethyl), an aralkyl group (e.g., o-hydroxybenzyl), and an aryl group (e.g., phenyl, 3,5-dichlorophenyl, o-methanesulfonamidophenyl, 4-methanesulfonylphenyl, 2-hydroxymethylphenyl). Particularly preferred among these groups is a hydrogen atom.

$E_2$ may be substituted by substituents, such as those described as substituents for $E_1$.

In formula (IV), $V_1$ is most preferably a —CO— group.

$E_2$ may be a group which causes cleavage of the $V_1$—$E_2$ portion from the remainder of the molecule and cyclization reaction producing a cyclic structure containing atoms in the —$V_1$—$E_2$ portion. Examples of such a group are described in JP-A-63-29751.

$B_1$ and $B_2$ each is most preferably a hydrogen atom.

In formula (IV), $E_1$ or $E_2$ may comprise a ballast group or a polymer commonly used in an immobile photographic additive such as a coupler. The ballast group is a group containing 8 or more carbon atoms, which does not have much effect on photographic properties. Such a ballast group can be selected from the group consisting of an alkyl group, an alkoxy group, a phenyl group, an alkylphenyl group, a phenoxy group, an alkylphenoxy group, etc. Examples of the polymer include those described in JP-A-l-100530.

In formula (IV), $E_1$ or $E_2$ may comprise a group which accelerates its adsorption to the surface of silver halide grains. Examples of such an adsorption accelerating group include thiourea groups, heterocyclic thioamide groups, mercapto heterocyclic groups and triazole groups as disclosed in U.S. Pat. Nos. 4,385,108, and 4,459,347, and JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246.

Specific examples of compounds represented by formula (IV) are shown below, but the present invention should not be construed as being limited thereto.

IV-1

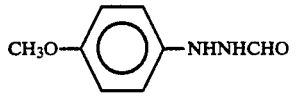

IV-2

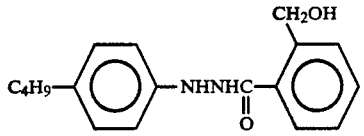

IV-3

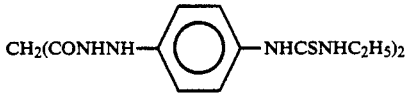

IV-4

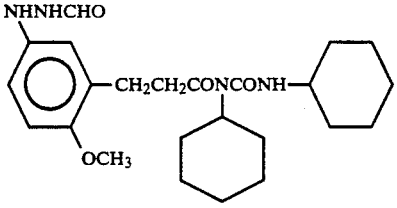

IV-5

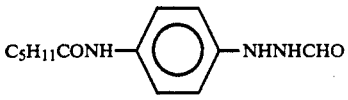

-continued
IV-6
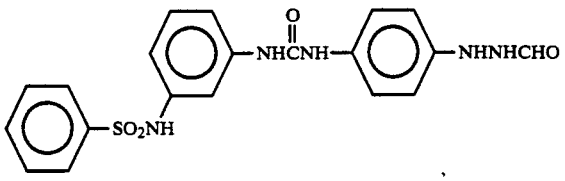
IV-7
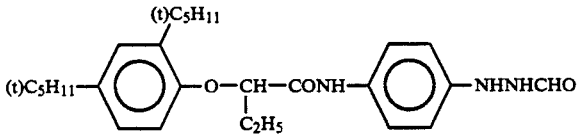
IV-8
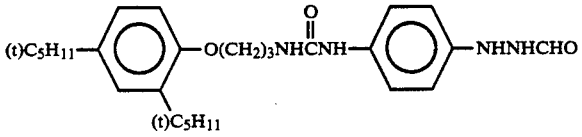
IV-9
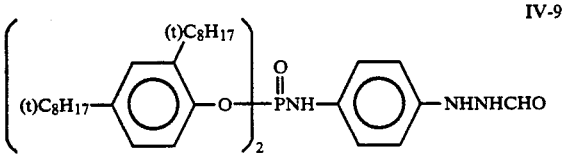
IV-10
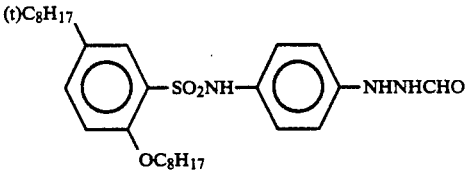
IV-11
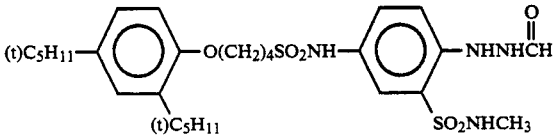
IV-12
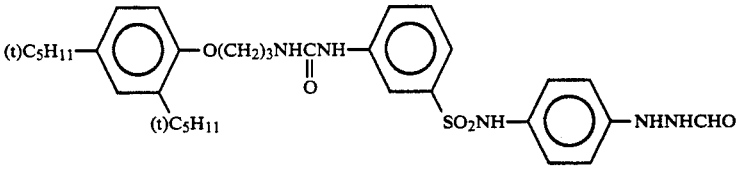
IV-13
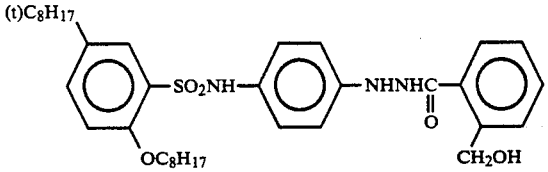
IV-14
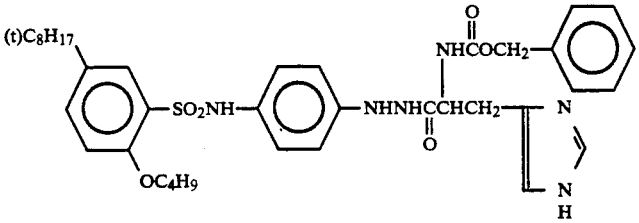
IV-15
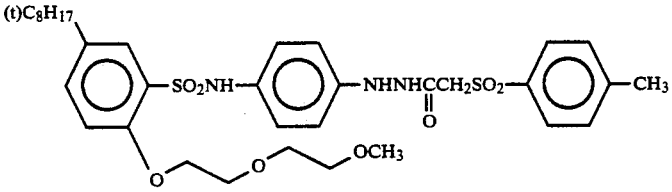

-continued
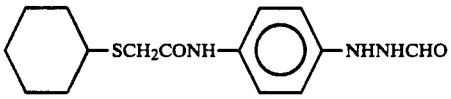
IV-16
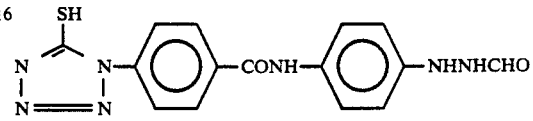
IV-17
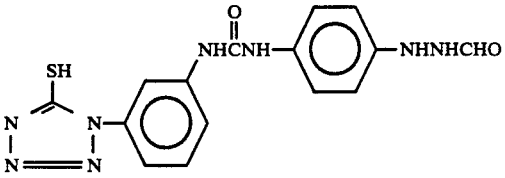
IV-18
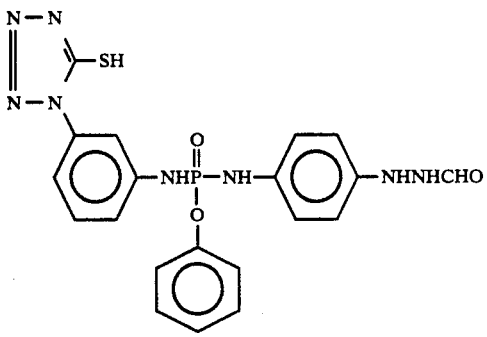
IV-19
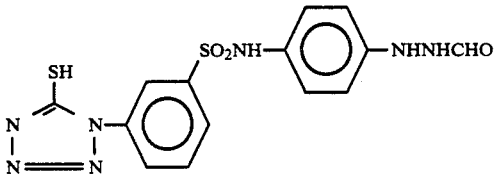
IV-20
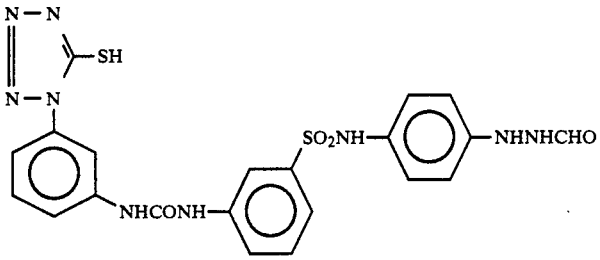
IV-21
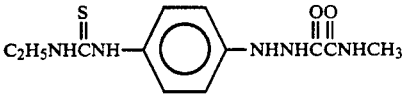
IV-22
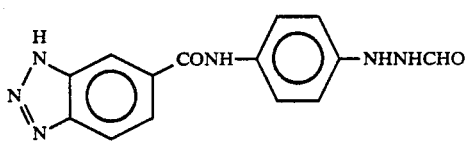
IV-23
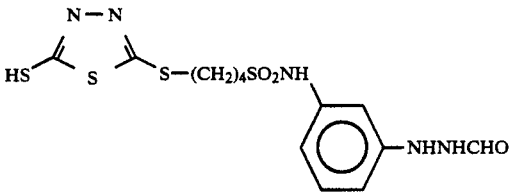
IV-24
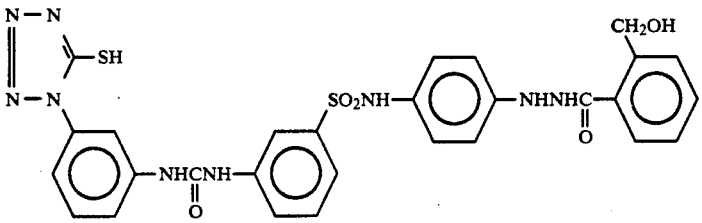
IV-25

-continued

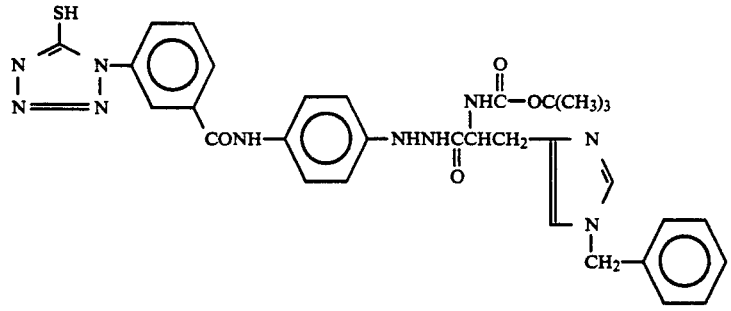

IV-26

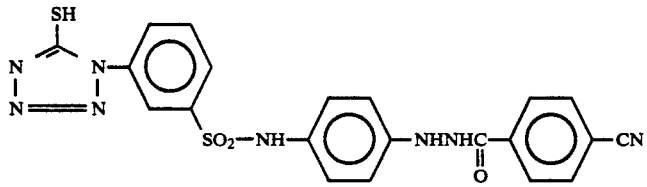

IV-27

The hydrazine derivatives to be used in the present invention include those described above as well as those described in *Research Disclosure,* No. 23516 (November 1983, p. 346) and references cited therein, U.S. Pat. Nos. 4,080,207, 4,269,929, 4,276,364, 4,278,748, 4,385,108, 4,459,347, 4,560,638, 4,478,928, and 4,686,167, British Patent 2,011,391B, JP-A-60-179734, JP-A-62-270948, JP-A-63-29751, JP-A-61-170733, JP-A-61-270744, JP-A-62-270948, JP-A-62-178246, JP-A-63-32538, JP-A-53-104047, JP-A-63-121838, JP-A-63-129337, JP-A-63-223744, JP-A-63-234244, JP-A-63-234245, JP-A-63-234246, JP-A-63-294552, JP-A-63-306438, JP-A-1-100530, JP-A-1-105941, JP-A-1-105943, JP-A-64-10233, JP-A-1-90439, JP-A-1-276128, JP-A-1-280747, JP-A-1-283548, JP-A-1-283549, JP-A-1-285940, JP-A-63-147339, JP-A-63-179760, JP-A-63-229163, JP-A-2-198440, JP-A-2-198441, JP-A-2-198442, JP-A-2-196234, JP-A-2-196235, JP-A-2-220042, JP-A-2-221953, JP-A-2-221954, JP-A-2-302750, JP-A-2-304550, EP 217310 and EP 356898.

In the present invention, the hydrazine derivative can be added to the silver halide emulsion layers or the other hydrophilic colloid layers. The hydrazine derivative may be added to at least one of the silver halide emulsion layers when plural silver halide emulsion layers exist.

In the present invention, the amount of the hydrazine derivative to be incorporated into the photographic material is preferably in the range of $1\times10^{-6}$ to $5\times10^{-2}$ mol, particularly $1\times10^{-5}$ to $2\times10^{-2}$ mol per mol of the silver halide.

The hydrazine derivative used in the present invention may be used in the form of solution in a proper organic solvent miscible with water, such as alcohols (e.g., methanol, ethanol, propanol, fluorinated alcohol), ketones (e.g., acetone, methyl ethyl ketone), dimethylformamide, dimethyl sulfoxide and methyl cellosolve.

The hydrazine derivative used in the present invention may also be used in the form of an emulsion dispersion mechanically prepared by a known emulsion dispersion method using an oil such as dibutyl phthalate, tricresyl phosphate, glyceryl triacetate and diethyl phthalate or an auxiliary solvent such as ethyl acetate and cyclohexanone or in the form of a dispersion prepared by a method known as a solid dispersion method using ball mill, colloid mill or ultrasonic wave to disperse powders of the redox compound of the present invention in water.

The light-sensitive silver halide emulsion to be used in the present invention may be any composition such as silver chloride, silver bromochloride, silver bromoiodide and silver bromochloroiodide.

The light-sensitive silver halide grains to be used in the present invention are preferably finely divided (e.g., 0.7 μm or less, particularly 0.5 μm or less). The grain size distribution is not basically limited but is preferably monodisperse. The term "monodisperse emulsion" as used herein means an "emulsion comprising grains in which at least 95% by weight or number of grains have a grain size falling within ±40% of the average grain size".

Light-sensitive silver halide grains in the photographic emulsions may have a regular crystal form such as a cube or an octahedron, or an irregular crystal form such as a sphere and or a plate, or a combination of these crystal forms.

The silver halide grains may have a phase which is uniform all over the grain or phases differing from core to shell. Two or more kinds of silver halide emulsions which have been separately prepared may be used in admixture.

In the process for the formation or physical ripening of silver halide grains, cadmium salt, sulfite, zinc salt, thallium salt, rhodium salt, or complex salt thereof, or indium salt or complex salt thereof may be present in the system.

The emulsion layers of the present invention or other hydrophilic colloidal layers may comprise a water-soluble dye as a filter dye or for the purpose of inhibiting irradiation or other various purposes. This filter dye can be a dye for further lowering photographic sensitivity, preferably an ultraviolet absorbent having a maximum spectral absorption in the inherent sensitivity range of silver halide or a dye having a substantial light absorption mainly in the range of 350 nm to 600 nm for improving the safety to safelight when used as a bright room-type light-sensitive material.

These dyes may be preferably incorporated into the emulsion layer or into a layer above the silver halide emulsion layer, i.e., a light-insensitive hydrophilic colloidal layer provided farther from the support than the silver halide emulsion layer, together with a mordant.

The amount of such a dye to be incorporated depends on its molar absorptivity and is normally in the range of $1\times10^{-2}$ g/m$^2$ to 1 g/m$^2$, preferably 50 mg/m$^2$ to 500 mg/m$^2$.

Specific examples of such a dye are further described in JP-A-63-64039. Some of these dyes are shown below:

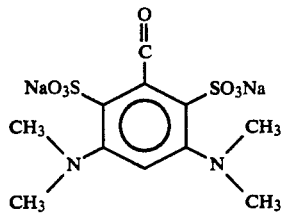

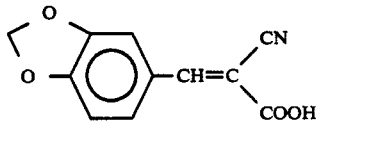

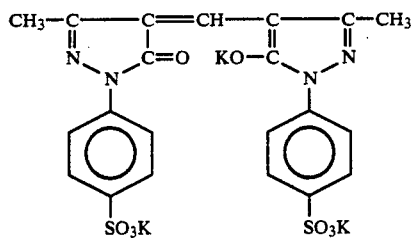

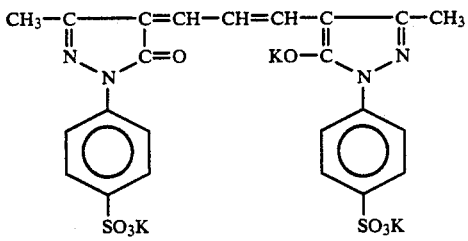

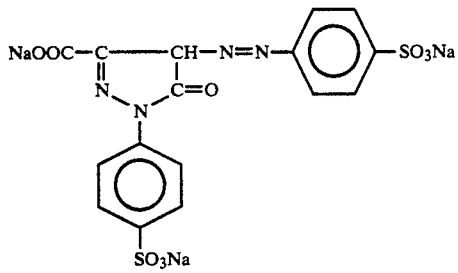

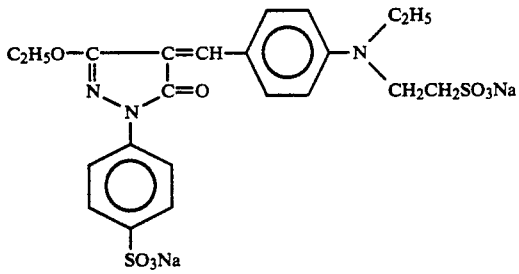

These dyes may be incorporated into a coating solution for the light-insensitive hydrophilic colloidal layer of the present invention in the form of solution in a proper solvent such as water, alcohol (e.g., methanol, ethanal, propanol), acetone, and methyl cellosolve or a mixture thereof.

Two or more kinds of these dyes may be used in combination.

The dye of the present invention may be used in an amount which permits handling in a bright room.

The optimum amount of these dyes to be used is normally in the range of $1\times10^{-3}$ g/m$^2$ to 1 g/m$^2$, preferably, $1\times10^{-3}$ g/m$^2$ to 0.5 g/m$^2$.

The silver halide emulsion to be used in the present process may or may not be subjected to chemical sensitization. Suitable methods for chemical sensitization of the silver halide emulsion include a sulfur sensitization method, a reduction sensitization method and a noble metal sensitization method. These chemical sensitization methods can be used singly or in combination.

The noble metal sensitization method include a gold sensitization method. In the gold sensitization method, there is used a gold compound, mainly gold complex salt. Noble metals other than gold, such as platinum, palladium and rhodium may be included. Specific examples of such compounds are described in U.S. Pat. No. 2,448,060, and British Patent 618,016.

As sulfur sensitizers there may be used sulfur compounds contained in gelatin, various sulfur compounds such as thiosulfate, thiourea, thiazole and rhodanine, etc.

As reduction sensitizers there may be used stannous salts, amines, formamidinesulfinic acid, silane compounds, etc.

The silver halide emulsion layer to be used in the present invention may comprise a known spectral sensitizing dye.

The light-sensitive material of the present invention may comprise various compounds for the purpose of inhibiting fogging during the preparation, storage or photographic processing of the light-sensitive material or for stabilizing photographic properties.

Preferred among these compounds are benzotriazoles (e.g., 5-methylbenzotriazole) and nitroindazoles (e.g., 5-nitroindazole). These compounds may be incorporated into the processing solution. The photographic light-sensitive material of the present invention may contain an inorganic or organic film hardener in the photographic emulsion layer or other hydrophilic colloidal layers. For example, activated vinyl compounds (e.g., 1,3,5-triacryloyl-hexahydro-s-triazine, 1,3-vinylsulfonyl-2-propanol), activated halogen compounds (e.g., 2,4-dichloro-6-hydroxy-s-triazine), and mucohalogenic acids may be used singly or in combination.

The photographic emulsion layer or other hydrophilic colloidal layers in the light-sensitive material prepared according to the present invention may comprise various surface active agents for the purpose, for example, as coating aids, as antistatic agents, for improvement of sliding properties, as emulsification and dispersion aids, and for prevention of adhesion, for improvement of photographic properties (e.g., development acceleration, increase in contrast, increase in sensitivity).

Surface active agents which are particularly preferable in the present invention are polyalkylene oxides with a molecular weight of 600 or more as described in JP-B-58-9412 (the term "JP-B"as used herein refers to an "examined Japanese patent publication").

For the purpose of stabilizing dimension, a polymer latex such as polyalkyl acrylate may be incorporated into the system.

Development accelerators or nucleation infectious development accelerators suitable for the present invention are the compounds disclosed in JP-A-53-77616, JP-A-54-37772, JP-A-53-137133, JP-A-60-140340 and JP-A-60-14959, as well as various compounds containing nitrogen or sulfur atoms.

The accelerator is preferably used in an amount of $1.0\times10^{-3}$ to 0.5 g/m$^2$, more preferably $5.0\times10^{-3}$ to 0.1 g/m$^2$, depending on its type.

In order to obtain an ultrahigh contrast photograph from the silver halide photographic material used in the present invention, a stable developer can be used without use of the conventional infectious developer or a high alkali developer with a pH value of about 13 as described in U.S. Pat. No. 2,419,975.

In other words, the silver halide photographic material of the present invention can be processed with a

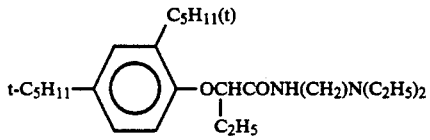

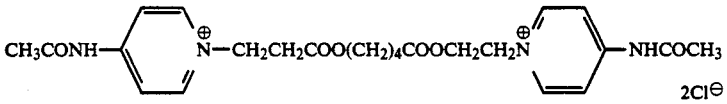

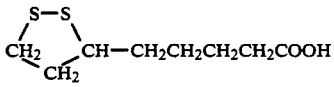

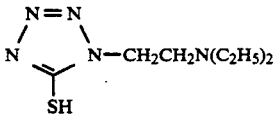

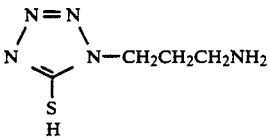

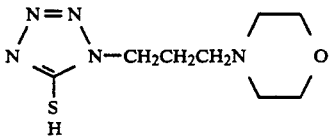

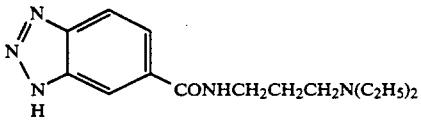

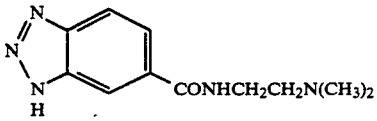

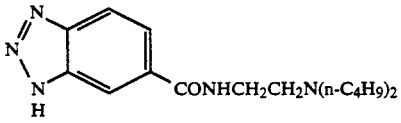

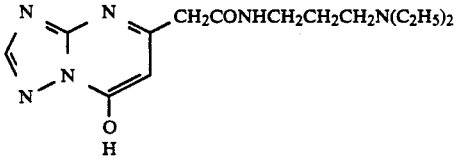

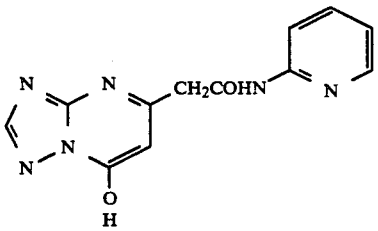

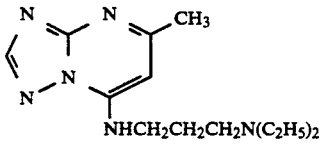

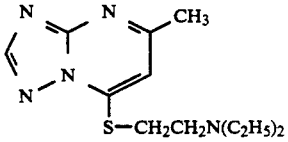

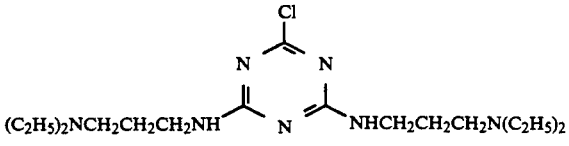

$(C_2H_5)_2NCH_2CH(OH)CH_2OH$ $n\text{-}C_4H_9N(C_2H_4OH)_2$ developer containing sulfite ions as preservatives in an amount of 0.20 mol/liter or more, preferably 0.50 mol/liter or more, and having a pH value of preferably 9.0 to 12.0, particularly preferably 11.0 to 12.0, to obtain a sufficiently ultrahigh negative image.

Since the compound of the present invention represented by formula (I) undergoes decomposition and deactivation in a developer due to a nucleophilic reaction with sulfite ions, the developer needs to contain sulfite ions in an amount of 0.2 mol/liter or more for the purpose of reducing the fatigue thereof.

The developing agents to be used in the present invention are not specifically limited. For example, dihydroxybenzenes (e.g., hydroquinone), 3-pyrazolidones (e.g., 1-phenyl-3-pyrazolidone, 4,4-dimethyl-l-phenyl-3-pyrazolidone), and aminophenols (e.g., N-methylpaminophenol) can be used singly or in combination.

The silver halide photographic material of the present invention is particularly adapted to be processed with a developer containing dihydroxybenzenes as the main developing agents and 3-pyrazolidones or aminophenols as the auxiliary developing agents. Preferably, the developer contains dihydroxybenzenes in an amount of 0.05 to 0.5 mol/liter and 3-pyrazolidones or aminophenols in an amount of 0.06 mol/liter or less.

Examples of additives which can be used in addition to the above mentioned components include development inhibitors such as boron compounds (e.g., boric acid, borax), sodium bromide, potassium bromide and potassium iodide, organic solvents such as ethylene glycol, diethylene glycol, triethylene glycol, dimethylformamide, methyl cellosolve, hexylene glycol, ethanol and methanol, and antifoggants or black pepper inhibitors such as indazole compounds (e.g., 1-phenyl-5-mercaptotetrazole, 5-nitroindazole) and benzotriazole compounds (e.g., 5-methylbenztriazole). Further, color toners, surface active agents, defoaming agents, hard water softeners, film hardeners, etc., may be used, if desired.

The developer to be used in the present invention may comprise amine compounds described in JP-A-56-106244 and JP-A-2-208652.

The developer to be used in the present invention may comprise as a silver stain inhibitor a compound described in JP-A-56-24347. The dissolution aids to be incorporated into the developer may be a compound described in JP-A-61-267759. Further, the pH buffer to be incorporated into the developer may be a compound described in JP-A-60-93433 or JP-A-62-186259.

The fixing agent may be a commonly used composition. This fixing agent can be thiosulfate or thiocyanate as well as organic sulfur compound known to serve as a fixing agent. The fixing solution to be used in the present invention may contain a water-soluble aluminum compound (e.g., aluminum sulfate, alum) as a film hardener. The amount of the water-soluble aluminum compound to be incorporated is normally in the range of 0.4 to 2.0 g/liter in terms of Al. Further, the oxidizing agent can be a trivalent iron compound in the form of a complex with ethylenediaminetetraacetate.

The processing temperature in the present process can be normally selected from 18° C. to 50° C.

The photographic processing is preferably effected by means of an automatic developing machine. In accordance with the present invention, even if the total processing time between the entrance and exit of the light-sensitive material from the automatic developing machine is set to 90 seconds to 120 seconds, a sufficiently ultrahigh contrast negative gradation photograph can be obtained.

The present invention will be further described in the following examples, but the present invention should not be construed as being limited thereto.

EXAMPLE 1

First Light-Sensitive Emulsion Layer

Preparation of Light-Sensitive Emulsion A

A 0 37M aqueous solution of silver nitrate and an aqueous solution of silver halide containing $(NH_4)_3RhCl_6$ in an amount of $1\times10^{-7}$ mol per mol of silver, $K_3IrCl_6$ in an amount of $5\times10^{-7}$ mol per mol of silver, 0.11M of potassium bromide and 0.27M of sodium chloride were added to an aqueous solution of gelatin containing sodium chloride and 1,3-dimethyl-2-imidazolidinethione with stirring by the double jet method at a temperature of 45° C. in 12 minutes to obtain silver bromochloride grains with an average grain size of 0.20 μm and a silver chloride content of 70 mol % so that nucleation was effected.

Similarly, a 0.63M aqueous solution of silver nitrate and an aqueous solution of halide salts containing 0.19M of potassium bromide and 0.47M of sodium chloride were added to the emulsion by the double jet method for 20 minutes. A $1\times10^{-3}$ mol KI solution was added to the emulsion for conversion. The emulsion was then washed with water by the ordinary flocculation method. Forty grams of gelatin was added to the emulsion so that the pH value and pAg value thereof were adjusted to 6.5 and 7.5, respectively. To the emulsion were then added sodium thiosulfate, chloroauric acid, and sodium benzenethiosulfonate in amounts of 5 mg, 8 mg and 7 mg per mol of silver. The emulsion was then chemically sensitized at a temperature of 60° C. for 45 minutes. To the emulsion were added 150 mg of 1,3,3a,7-tetraazaindene and proxel and phenoxyethanol as stabilizers. Cubic silver bromochloride grains with an average grain size of 0.28 μm and a silver chloride content of 70 mol % were obtained. (Grain size fluctuation coefficient: 9%)

Coating of First Light-Sensitive Emulsion Layer

To these emulsions were each added 5-{[3-(4-sulfobutyl)-5-chloro -2-benzoxazolizilidene]ethylideno}-1-hydroxyethoxyethyl-3-(2-pyridyl)-2-thiohydantoin potassium as a sensitizing agent in an amount of $1\times10^{-}$mol per mol of silver. To the emulsion were then added 1-phenyl-5-mercaptotetrazole in an amount of $2\times10^{-4}$ mol per mol of silver, a compound of the following structural formula (a) as a shortwave cyanine dye in an amount of $5\times10^{-4}$ mol per mol of silver, a compound of the following structural formula (b) as a polymer in an amount of 200 mg/m$^2$, hydroquinone in an amount of 50 mg/m$^2$, a polyethyl acrylate dispersion in an amount of 200 mg/m$^2$, 3-bisvinylsulfonyl-2-propanol as a film hardener in an amount of 200 mg/m$^2$, and a hydrazine compound of the following structural formula (c) in an amount of $2.8\times10^{-5}$ mol/m$^2$. The emulsion was coated on a support in an amount such that the coated amount of silver and gelatin reached 3.6 g/m$^2$ and 2.0 g/m$^2$, respectively.

Compound (a)

-continued

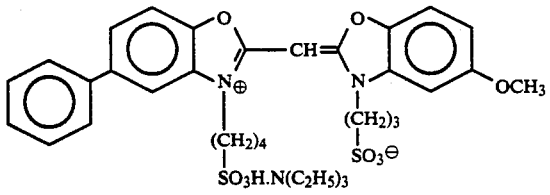

Compound (b)

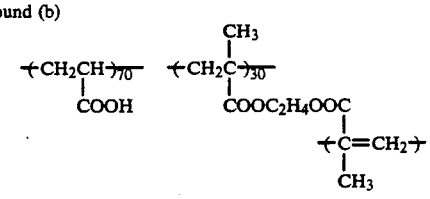

Hydrazine Compound (c)

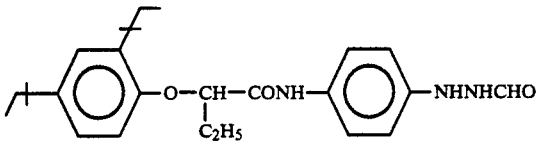

| Coatinq of Interlayer | |
|---|---|
| Gelatin | 1.0 g/m$^2$ |
| 1,3-Bisvinylphosphonyl-2-propanol | 4.0 wt % based on gelatin |

Second Light-Sensitive Emulsion Layer

Preparation of Light-Sensitive Emulsion B

A 1.0M aqueous solution of silver nitrate and an aqueous solution of silver halide containing $(NH_4)_3RhCl_6$ in an amount of $3\times10^{-7}$ mol per mol of silver, 0.3M of potassium bromide and 0.74M of sodium chloride were added to an aqueous solution of gelatin containing sodium chloride and 1,3-dimethyl-2-imidazolidinethione with stirring in a double jet method at a temperature of 45° C. for 30 minutes to obtain silver bromochloride grains with an average grain size of 0.28 μm and a silver chloride content of 70 mol %.

The emulsion was then washed with water by an ordinary flocculation method. Forty grams of gelatin was added to the emulsion so that the pH value and pAg value thereof were adjusted to 6.5 and 7.5, respectively. To the emulsion were then added sodium thiosulfate and chloroauric acid in amounts of 5 mg and 8 mg. The emulsion was then chemically sensitized at a temperature of 60° C. for 60 minutes. To the emulsion was added 150 mg of 1,3,3a,7-tetraazaindene as a stabilizer. Cubic silver bromochloride grains with an average grain size of 0.28 μm and a silver chloride content of 70 mol % were obtained. (Grain size fluctuation coefficient: 10%)

Coating of Second Light-Sensitive Emulsion Layer

The light-sensitive emulsion B was again re-dissolved in a solvent. To the emulsion were added 5-{[3-(4-sulfobutyl)-5-chloro-2-benzoxazolizilidene]ethylideno}-1-hydroxyethoxyethyl-3-(2-pyridyl)-2-thiohydantoin potassium as a sensitizing dye in an amount of $1.0\times10^{-}$mol per mol of silver and a $1.0\times10^{-3}$ mol KI solution. To the emulsion were then added 1-phenyl-5-mercaptotetrazole in an amount of $2\times10^{-4}$ mol per mol of silver, a polyethyl acrylate dispersion in an amount of 50 mg/m$^2$, 1,3-bisvinylsulfonyl-2-propanol as a film hardener in an amount of 4.0 wt % based on gelatin, and the compound of formula (I) or comparative redox compound as shown in Tables 1 and 2 in an amount of $1.0\times10^{-4}$ mol/m$^2$. The emulsion was coated in an amount such that the coated amount of silver and gelatin reached 0.4 g/m$^2$ and 0.5 g/m$^2$, respectively.

Coating of Protective Layer

Onto the second light-sensitive emulsion layer were coated 1.5 g/m$^2$ of gelatin and 0.3 g/m$^2$ of polymethyl methacrylate grains (average grain size: 2.5 μm) as a protective layer with the following surface active agents.

| Surface Active Agent | |
|---|---|
| 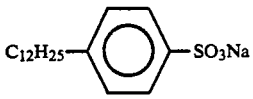 | 37 mg/m$^2$ |
| $CH_2COOC_6H_{13}$<br>\|<br>$CHCOOC_6H_{13}$<br>\|<br>$SO_3Na$ | 37 mg/m$^2$ |
| $C_8H_{17}SO_2NCH_2COOK$<br>\|<br>$C_3H_7$ | 2.5 mg/m$^2$ |

A back layer and a back protective layer were prepared as follows:

| Formulation of Back Layer | |
|---|---|
| Gelatin | 3 g/m$^2$ |
| Latex Polyethyl Acrylate | 2 g/m$^2$ |
| Surface Active Agent (sodium p-dodecylbenzenesulfonate) | 40 mg/m$^2$ |
| Gelatin Hardener | 110 mg/m$^2$ |

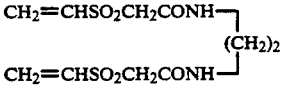

Dye (mixture of Dye (a), Dye (b) and Dye (c)):

Dye (a) 50 mg/m$^2$

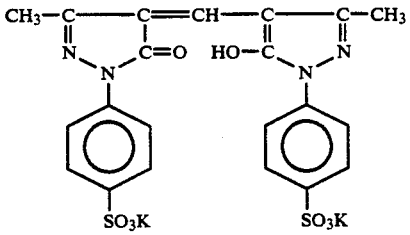

Dye (b) 100 mg/m$^2$

-continued

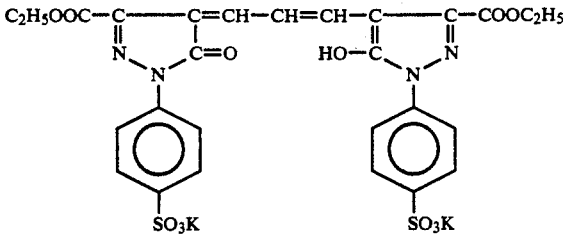

Dye (c) 50 mg/m²

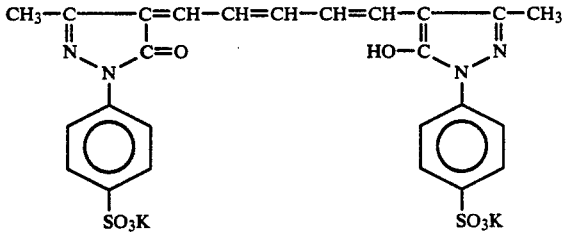

Back Protective Layer

| | |
|---|---|
| Gelatin | 0.8 g/m² |
| Finely Divided Polymethyl Methacrylate Grains (average grain diameter: 4.5 μm) | 30 mg/m² |
| Sodium Dihexyl-α-sulfosuccinate | 15 mg/m² |
| Sodium Dodecylbenzenesulfonate | 15 mg/m² |
| Sodium Acetate | 40 mg/m² |
| Fluorine Surface Active Agent | 5 mg/m² |

$C_8H_{17}SO_2N(C_3H_7)-CH_2COOK$

On a 100 μm thick polyester film support was coated the first light-sensitive emulsion layer as the lowermost layer. On the first light-sensitive emulsion layer were then coated the second light-sensitive emulsion layer containing a redox compound with an interlayer interposed therebetween and, simultaneously, a protective layer to prepare specimens as shown in Table 1.

Test-1

The specimens as shown in Tables 1 and 2 were exposed to light from a tungsten lamp with a color temperature of 3,200° K. through an optical wedge and in the manner as described below, developed with the following Developer A comprising potassium sulfite as shown in Tables 1 and 2 at a temperature of 34° C. for 30 seconds, fixed, rinsed, and then dried.

| Developer A | |
|---|---|
| Hydroquinone | 50.0 g |
| N-Methyl-p-aminophenol | 0.3 g |
| Sodium Hydroxide | 18.0 g |
| 5-Sulfosalicylic Acid | 55.0 g |
| Disodium Ethylenediaminetetraacetate | 1.0 g |
| Potassium Bromide | 10.0 g |
| 5-Methylbenzotriazole | 0.4 g |
| 2-Mercaptobenzimidazole-5-sulfonic Acid | 0.3 g |
| Sodium 3-(5-Mercaptotetrazole) Benzenesulfonate | 0.2 g |
| N-n-Butyl Diethanolamine | 15.0 g |
| Sodium Toluenesulfonate | 8.0 g |
| Water to make | 1 liter |
| pH adjusted with potassium to | 11.6 |

The reproducibility of halftone gradation was evaluated as follows:

A step wedge having a stepwise gradation of dot percentage was prepared using a monochromatic halftone scanner SCANERT30 and a paper SP100wp dedicated for this purpose produced by Fuji Photo Film Co., Ltd. The number of screen lines upon exposure was 150 lines/inch.

The original and the specimens were then mounted on a process camera C-690 produced by Dainippon Screen Mfg. Co., Ltd. (Autocompanica, xenon light source) at predetermined positions. The reflective original was then irradiated with light from an Xe lamp so that it was photographed on the light-sensitive material. The exposure time was adjusted such that the portion of 80% step wedge on the original corresponds to the portion of 10% step wedge on the light-sensitive material.

For the relative evaluation of the reproducibility of halftone gradation, five steps were defined by the destroyability of halftone on the shadow portion having 10% halftone. Step "5"indicates the least destroyable halftone, and Step "1"indicates the most destroyable halftone. Step in between "4"and "3"is defined as "3.5". For halftone original plate for plate making, Step "3"is the lowest allowable level. Steps "2"and "1"are impractical levels.

For the evaluation of halftone quality, five steps were visually defined. Step "5"indicates the best quality, and Step "1"indicates the poorest quality. For halftone original plate for plate making, Steps "5"and "4"are practical levels, Step "3"is the lowest allowable level. Steps "2"and "1"are impractical levels.

The average gradation is represented by the following equation:

$$\frac{(3.0 - 0.3)}{\log(\text{exposure amount giving a density of } 3.0) - \log(\text{exposure amount giving a density of } 0.3)}$$

The results are shown in Tables 1 and 2.

TABLE 1

| Sample No. | Redox Compound | Added Amount of Potassium Sulfite (mol/liter) | Average Gradation (γ) | Halftone Gradation Reproducibility | Halftone Quality | Remarks |
|---|---|---|---|---|---|---|
| 1-1 | — | 0.8 | 16.4 | 3 | 3 | Comparison |
| 1-2 | Comparative Compound (A) | " | 14.9 | 3 | 3 | " |
| 1-3 | Comparative Compound (B) | " | 17.0 | 3 | 3.5 | " |
| 1-4 | Comparative Compound (C) | " | 15.8 | 3 | 3 | " |
| 1-5 | Comparative | " | 15.3 | 3 | 3 | " |

TABLE 1-continued

| Sample No. | Redox Compound | Added Amount of Potassium Sulfite (mol/liter) | Average Gradation (G) | Halftone Gradation Reproducibility | Halftone Quality | Remarks |
|---|---|---|---|---|---|---|
| | Compound (D) | | | | | |
| 1-6 | Comparative Compound (E) | 0.1 | 16.2 | 4 | 4.5 | " |
| 1-7 | Comparative Compound (E) | 0.8 | 15.3 | 4 | 5 | " |
| 1-8 | Comparative Compound (F) | " | 17.0 | 4 | 5 | " |
| 1-9 | Comparative Compound (G) | 0.1 | 16.8 | 4 | 5 | " |
| 1-10 | Comparative Compound (G) | 0.8 | 15.6 | 4 | 5 | " |
| 1-11 | Comparative Compound (H) | 0.1 | 9.4 | 4 | 4.5 | " |
| 1-12 | Comparative Compound (H) | 0.8 | 9.1 | 4 | 4.5 | " |
| 1-13 | Present Compound (2) | 0.1 | 16.4 | 5 | 5 | " |
| 1-14 | Present Compound (2) | 0.8 | 18.1 | 5 | 5 | Invention |
| 1-15 | Present Compound (3) | 0.1 | 17.5 | 4.5 | 4.5 | Comparison |
| 1-16 | Present Compound (3) | 0.2 | 18.0 | 4.5 | 5 | Invention |
| 1-17 | Present Compound (3) | 0.8 | 18.2 | 4.5 | 5 | " |
| 1-18 | Present Compound (6) | 0.1 | 17.3 | 4.5 | 4.5 | Comparison |
| 1-19 | Present Compound (6) | 0.2 | 17.6 | 4.5 | 5 | Invention |
| 1-20 | Present Compound (6) | 0.8 | 18.0 | 4.5 | 5 | " |

TABLE 2

| Sample No. | Redox Compound | Added Amount of Potassium Sulfite (mol/liter) | Average Gradation (G) | Halftone Gradation Reproducibility | Halftone Quality | Remarks |
|---|---|---|---|---|---|---|
| 1-21 | Present Compound (10) | 0.1 | 15.1 | 4.5 | 5 | Comparison |
| 1-22 | Present Compound (10) | 0.2 | 16.2 | 5 | 5 | Invention |
| 1-23 | Present Compound (10) | 0.8 | 15.4 | 5 | 5 | " |
| 1-24 | Present Compound (12) | 0.1 | 14.7 | 4.5 | 4.5 | Comparison |
| 1-25 | Present Compound (12) | 0.8 | 15.9 | 5 | 5 | Invention |
| 1-26 | Present Compound (14) | 0.1 | 16.0 | 4.5 | 4.5 | Comparison |
| 1-27 | Present Compound (14) | 0.2 | 18.2 | 5 | 5 | Invention |
| 1-28 | Present Compound (14) | 0.8 | 18.8 | 5 | 5 | " |
| 1-29 | Present Compound (20) | 0.1 | 15.2 | 5 | 4.5 | Comparison |
| 1-30 | Present Compound (20) | 0.8 | 16.9 | 5 | 5 | Invention |
| 1-31 | Present Compound (21) | 0.1 | 14.9 | 5 | 5 | Comparison |
| 1-32 | Present Compound (21) | 0.8 | 16.0 | 5 | 5 | Invention |
| 1-33 | Present Compound (26) | 0.1 | 15.7 | 5 | 5 | Comparison |
| 1-34 | Present Compound (26) | 0.8 | 17.1 | 5 | 5 | Invention |

Comparative Compound (A)
(Compound 28 as described in JP-A-61-213847)

-continued

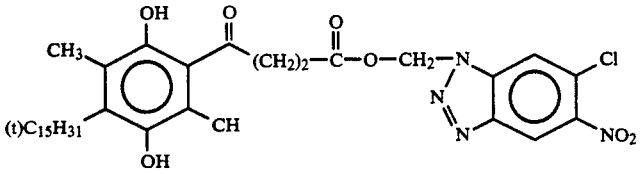

Comparative Compound (B)
(Compound 2 as described in JP-A-62-260153)

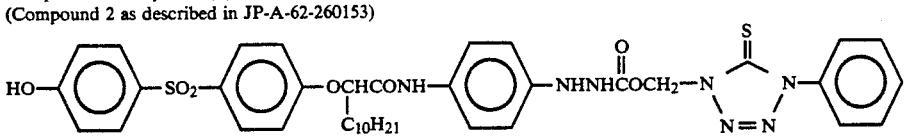

Comparative Compound (C)
(Compound 10 as described in JP-A-64-88451)

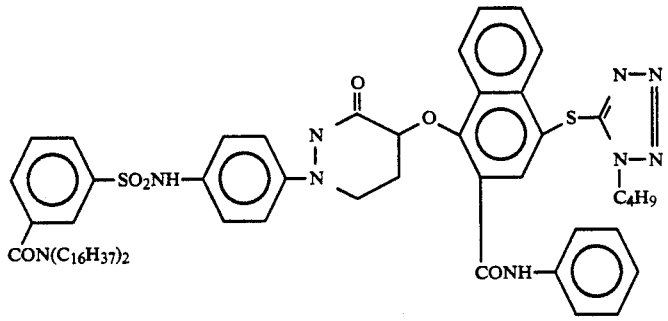

Comparative Compound (D)
(Compound 13 as described in JP-A-64-72140)

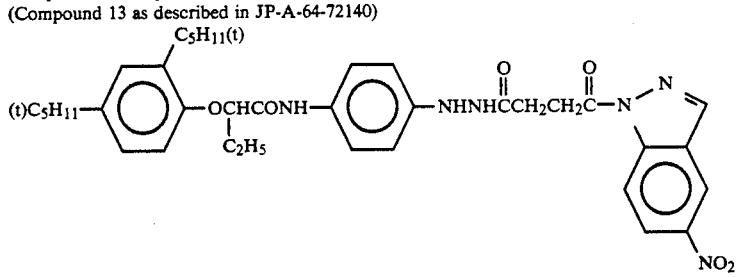

Comparative Compound (E) (Compound 17 as described in Japanese Patent Application No. 2-62337)

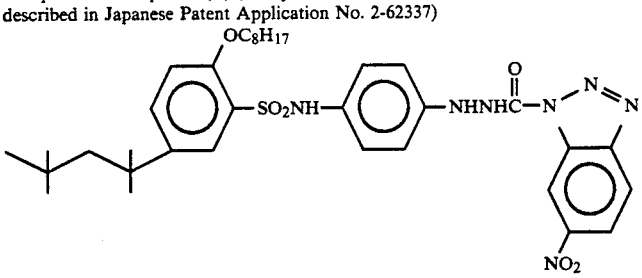

Comparative Compound (F) (Compound 14 as described in Japanese Patent Application No. 2-62337)

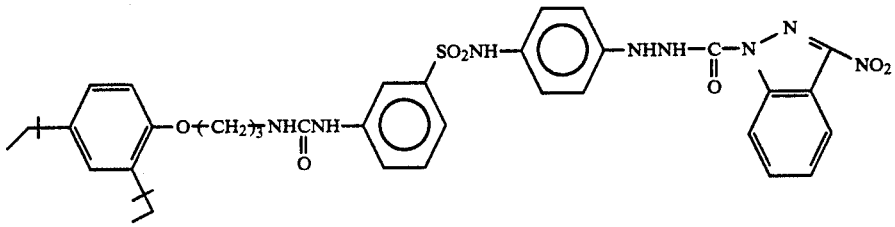

Comparative Compound G (Compound 18 as described in Japanese Patent Application No. 2-62337)

-continued

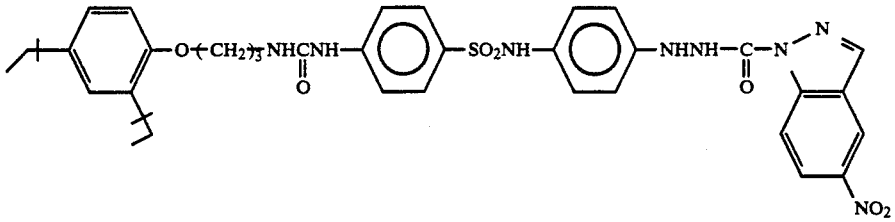

Comparative Compound H (Compound 20 as described in Japanese Patent Application No. 2-62337)

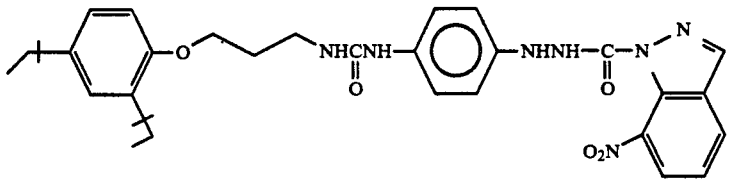

As is apparent from the results of Tables 1 and 2, the specimens comprising the compounds of the present invention and Comparative Compounds E, F and G maintain a high contrast and an excellent halftone gradation reproducibility and halftone quality. The specimens comprising Comparative Compound H exhibit an excellent halftone gradation reproducibility and halftone quality but a remarkably lowered contrast.

Test-2

Adjustment of Fatigued Developer

The specimen according to Sample No. 1-1 which was used in Test-1 was processed with 34 liters of the developer having the same composition as used for processing Sample No. 1-1 in Test-1 34° C. for 30 seconds, using the automatic developing machine ("FG-710NH"manufactured by Fuji Photo Film Co., Ltd.).

Processing Condition

Amount of Processing:

A 50.8 cm×61 cm light-sensitive specimen was exposed in such a manner that the percentage blacking reached 80% and two hundred sheets were processed a day.

Period:

The processing was effected for 10 consecutive days and 30 consecutive days.

Replenishment Amount:

75 ml/50.8 cm×61 cm (one sheet)

The developer which was fatigued by processing (running) for 10 consecutive days or for 30 consecutive days under the above processing condition, "Fatigued Developer B1"was prepared.

Also, the developer which was running-fatigued, "Fatigued Developer B2"was prepared using the developer which was used for processing Sample No. 1-2 in Test-1, in a similar manner as above.

Further, Fatigued Developers B3 to B34 also were prepared in the same manner as above.

Comparison of Photographic Characteristics

Another batch of the above mentioned light-sensitive material specimens were exposed to light in the same manner as in Test-1, and then processed with the kinds of the developers which had not been fatigued and which had been fatigued. The difference ($\Delta\log E_1$) in photographic sensitivity between with the developers which had not been fatigued and the developers which had been fatigued is shown in Tables 3 and 4. The photographic sensitivity (log E) is the logarithm of the exposure amount required to give a density of 1.5.

Fuji Film GRANDEX Film GA100 was exposed to light and developed with the developers which had not been fatigued and the developers which had been fatigued in the same manner as in Test-1. The difference ($\Delta\log E_2$) in photographic sensitivity between with the developers which had not been fatigued and the developers which had been fatigued is shown in Tables 3 and 4. The photographic sensitivity (log E) is the logarithm of the exposure amount required to give a density of 1.5.

The results are set forth in Tables 3 and 4.

TABLE 3

| | | Change in Photographic Sensitivity with Fatigued Developer | | | |
|---|---|---|---|---|---|
| | | 10 Days | | 30 Days | |
| Sample No. | Fatigued Developer | Light-Sensitive Material Used in Fatiguing Developers ($\Delta\log E_1$) | GRANDEX Film GA-100 ($\Delta\log E_2$) | Light-Sensitive Material Used in Fatiguing Developers ($\Delta\log E_1$) | Remarks |
| 2-1 | B1 | −0.04 | −0.03 | −0.07 | Comparison |
| 2-2 | B2 | −0.33 | −0.35 | −0.50 | " |
| 2-3 | B3 | −0.32 | −0.36 | −0.47 | " |
| 2-4 | B4 | −0.36 | −0.37 | −0.51 | " |
| 2-5 | B5 | −0.30 | −0.33 | −0.48 | " |
| 2-6 | B6 | −0.33 | −0.33 | −0.44 | " |
| 2-7 | B7 | −0.34 | −0.31 | −0.47 | " |
| 2-8 | B8 | −0.29 | −0.33 | −0.45 | " |
| 2-9 | B9 | −0.30 | −0.32 | −0.48 | " |
| 2-10 | B10 | −0.03 | −0.33 | −0.52 | " |

TABLE 3-continued

| Sample No. | Fatigued Developer | Change in Photographic Sensitivity with Fatigued Developer: 10 Days, Light-Sensitive Material Used in Fatiguing Developers (Δlog $E_1$) | 10 Days, GRANDEX Film GA-100 (Δlog $E_2$) | 30 Days, Light-Sensitive Material Used in Fatiguing Developers (Δlog $E_1$) | Remarks |
|---|---|---|---|---|---|
| 2-11 | B11 | −0.09 | −0.09 | −0.5 | " |
| 2-12 | B12 | −0.04 | −0.05 | −0.06 | " |
| 2-13 | B13 | −0.08 | −0.09 | −0.17 | " |
| 2-14 | B14 | −0.03 | −0.04 | −0.07 | Invention |
| 2-15 | B15 | −0.10 | −0.10 | −0.20 | Comparison |
| 2-16 | B16 | −0.04 | −0.05 | −0.08 | Invention |
| 2-17 | B17 | −0.04 | −0.04 | −0.07 | " |
| 2-18 | B18 | −0.09 | −0.11 | −0.22 | Comparison |
| 2-19 | B19 | −0.03 | −0.05 | −0.07 | Invention |
| 2-20 | B20 | −0.03 | −0.04 | −0.06 | " |

TABLE 4

| Sample No. | Fatigued Developer | Change in Photographic Sensitivity with Fatigued Developer: 10 Days, Light-Sensitive Material Used in Fatiguing Developers (Δlog $E_1$) | 10 Days, GRANDEX Film GA-100 (Δlog $E_2$) | 30 Days, Light-Sensitive Material Used in Fatiguing Developers (Δlog $E_1$) | Remarks |
|---|---|---|---|---|---|
| 2-21 | B21 | −0.10 | −0.11 | −0.19 | Comparison |
| 2-22 | B22 | −0.04 | −0.04 | −0.10 | Invention |
| 2-23 | B23 | −0.03 | −0.04 | −0.08 | " |
| 2-24 | B24 | −0.09 | −0.08 | −0.22 | Comparison |
| 2-25 | B25 | −0.03 | −0.04 | −0.09 | Invention |
| 2-26 | B26 | −0.09 | −0.09 | −0.19 | Comparison |
| 2-27 | B27 | −0.05 | −0.04 | −0.10 | Invention |
| 2-28 | B28 | −0.04 | −0.03 | −0.07 | " |
| 2-29 | B29 | −0.10 | −0.11 | −0.22 | Comparison |
| 2-30 | B30 | −0.05 | −0.04 | −0.10 | Invention |
| 2-31 | B31 | −0.11 | −0.09 | −0.21 | Comparison |
| 2-32 | B32 | −0.04 | −0.03 | −0.09 | Invention |
| 2-33 | B33 | −0.09 | −0.11 | −0.19 | Comparison |
| 2-34 | B34 | −0.04 | −0.05 | −0.10 | Invention |

As is apparent from the results of Tables 3 and 4, when the specimens comprising the present compounds and Comparative Compound H are processed with the developer comprising 0.2 mol/liter and 0.8 mol/liter of potassium sulfite, they exhibit an extremely small change in photographic sensitivity which is the same level as that of Specimen 2-1. This tendency becomes remarkable particularly when the processing was effected for 30 consecutive days. On the contrary, it was found that when the specimens comprising Comparative Compounds A, B, C, D, E, F and G were processed with the developer containing potassium sulfite in an amount of only 0.10 mol/liter, they exhibit a large change in photographic sensitivity and cause a reduction in the activity of the developer.

Test-3

The comparative specimens and the present specimens were stored for 5 days under the following three different environmental conditions, returned to the normal temperature and humidity conditions, and then examined for photographic properties in the same manner as in Test 1. The developers used all had a potassium sulfate concentration of 0.8 mol/liter.

Specimen Storage Condition a. Normal temperature, normal humidity
b. 50° C., 70% RH
c. 60° C., 40% RH The difference (Δlog $E_3$ and Δlog $E_4$) in photographic sensitivity between with the condition a, the condition b and the condition c is shown in Table 5. The photographic sensitivity (log E) is the logarithm of the exposure amount required to give a density of 1.5.

The results are set forth in Table 5.

TABLE 5

| Sample No. | Redox Compound | Sensitivity Change (Δlog $E_3$) at at 50° C., 70% RH | Sensitivity Change (Δlog $E_4$) at at 60° C., 40% RH |
|---|---|---|---|
| 3-1 | — | +0.10 | +0.14 |
| 3-2 | Comparative Compound (A) | −0.20 | −0.11 |
| 3-3 | Comparative Compound (B) | −0.14 | −0.09 |
| 3-4 | Comparative Compound (C) | −0.15 | −0.10 |
| 3-5 | Comparative Compound (D) | −0.17 | −0.07 |
| 3-6 | Comparative Compound (E) | −0.19 | −0.09 |
| 3-7 | Comparative Compound (F) | −0.15 | −0.08 |
| 3-8 | Comparative Compound (G) | −0.20 | −0.10 |
| 3-9 | Comparative Compound (H) | −0.22 | −0.11 |
| 3-10 | Invention Compound (2) | −0.10 | −0.05 |
| 3-11 | Invention Compound (3) | −0.11 | −0.05 |
| 3-12 | Invention Compound (6) | −0.10 | −0.06 |
| 3-13 | Invention Compound (10) | −0.07 | −0.03 |
| 3-14 | Invention Compound (12) | −0.06 | −0.03 |
| 3-15 | Invention Compound (14) | −0.05 | −0.03 |
| 3-16 | Invention Compound (20) | −0.05 | −0.02 |
| 3-17 | Invention Compound (21) | −0.06 | −0.03 |
| 3-18 | Invention Compound (26) | −0.06 | −0.03 |

As is apparent from the results of Table 5, the specimens comprising the present compounds exhibit less of a change in photographic sensitivity as compared with those comprising the comparative compounds. In particular, the specimens comprising the present compounds 10, 12, 14, 20, 21 and 26 exhibit a reduced change in photographic sensitivity.

When in accordance with the method of the present invention, a silver halide photographic material comprising a compound represented by formula (I) is processed with a developer with a pH value of 9.0 to 12.0 containing sulfites in an amount of 0.20 mol/liter or more, stable formation of an ultrahigh contrast image with reduced black peppers and an excellent image quality can be achieved.

While the invention has been described in detail and with reference to specific embodiments thereof, it will be apparent to one skilled in the art that various changes and modifications can be made therein without departing from the spirit and scope thereof.

What is claimed is:

1. A method for forming an image, which comprises processing with a developer having a pH value of 9 to 12 and comprising 0.2 mol/liter or more of a sulfite, an imagewise exposed silver halide photographic material comprising a compound represented by formula (I):

$$\text{ED—(Time)}_t\text{—(Link)}_s\text{—Het} \qquad \text{(I)}$$

wherein ED represents a group which undergoes a reaction with an oxidation product of a developing agent to release $(\text{Time})_t$-$(\text{Link})_s$-Het; Time represents a divalent group which releases $(\text{Link})_s$-Het after being released from ED; Link represents a divalent group containing at least one hetero atom, and the Link is connected to ED-$(\text{Time})_t$ via one of the hetero atoms; t and s each represents an integer of 0 or 1; and Het represents a group represented by formula (II):

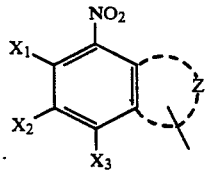

(II)

wherein $X_1$, $X_2$ and $X_3$ each represents a hydrogen atom, a halogen atom or a monovalent group; and Z represents an atomic group required to form a 5- to 6-membered nitrogen-containing heterocyclic group, with the proviso that when the group represented by formula (II) is a nitroindazolyl group-containing compound, it is a 4-nitroindazolyl group-containing compound.

2. The method for forming an image as claimed in claim 1, wherein said compound represented by formula (I) is a compound represented by formula (III):

$$R_1\text{—}\underset{\underset{A_1}{|}}{N}\text{—}\underset{\underset{A_2}{|}}{N}\text{—}G_1\text{—(Time)}_t\text{—(Link)}_s\text{—Het} \qquad \text{(III)}$$

wherein Time, Link, Het, t and s have the same meaning as defined in formula (I); $R_1$ represents an aliphatic group or an aromatic group; $G_1$ represents —CO—, —COCO—, —CS—, —C(=$NG_2R_2$)—, —SO—, —$SO_2$— or —P(O)($G_2R_2$)—; $G_2$ represents a single bond, —O—, —S— or —N($R_2$)—; $R_2$ represents a hydrogen atom or a group having the same meaning as $R_1$, with the proviso that when there is a plurality of $R_2$ groups in one molecule, they may be the same or different; and one of $A_1$ and $A_2$ is a hydrogen atom, and the other is a hydrogen atom, an acyl group, an alkyl group or an arylsulfonyl group.

3. The method for forming an image as claimed in claim 2, wherein said nitrogen-containing heterocyclic group represented by formula (II) is a benzimidazole ring or a benzotriazole ring.

4. The method for forming an image as claimed in claim 3, wherein $X_2$ in formula (II) is a hydrogen atom or an alkyl group and $X_3$ in formula (II) is a hydrogen atom or a halogen atom.

5. The method for forming an image as claimed in claim 1, wherein the light-sensitive material further comprises a hydrazine compound.

6. The method for forming an image as claimed in claim 5, wherein said hydrazine compound is represented by formula (IV):

$$E_1\text{—}\underset{\underset{B_1}{|}}{N}\text{—}\underset{\underset{B_2}{|}}{N}\text{—}V_1\text{—}E_2 \qquad \text{(IV)}$$

wherein $E_1$ represents an aliphatic group or an aromatic group; $E_2$ represents a hydrogen atom, an alkyl group, an aryl group, an alkoxy group, an aryloxy group, an amino group or a hydrazino group; $V_1$ represents —CO—, —$SO_2$—, —SO—, —P(O)($E_3$)—, —CO—CO—, a thiocarbonyl group or an iminomethylene group; $B_1$ and $B_2$ each represents a hydrogen atom or one of $B_1$ and $B_2$ represents a hydrogen atom and the other represents a substituted or unsubstituted alkylsulfonyl group, a substituted or unsubstituted arylsulfonyl group or a substituted or unsubstituted acyl group; and $E_3$ has the same meaning as $E_2$ and may be the same or different from $E_2$.

7. The method for forming an image as claimed in claim 5, wherein said hydrazine compound is used in an amount of $1\times10^{-6}$ to $5\times10^{-2}$ mol per mol of the silver halide.

* * * * *